US005255609A

United States Patent [19]

Miyagawa et al.

[11] Patent Number: 5,255,609

[45] Date of Patent: Oct. 26, 1993

[54] SUSPENSION SUPPORT SYSTEM FOR AN OVERHEAD CONVEYOR SYSTEM WITH CLAMP TYPE CONNECTORS WHICH DO NOT PENETRATE EXISTING STRUCTURE

[75] Inventors: Kozo Miyagawa, Hendersonville; Gregory A. Clark, Gallatin, both of Tenn.

[73] Assignee: Tsubaki Conveyor of American, Inc., Portland, Tenn.

[21] Appl. No.: 831,920

[22] Filed: Feb. 6, 1992

[51] Int. Cl.[5] ..... E01B 25/24

[52] U.S. Cl. ..... 104/111; 198/861.1

[58] Field of Search ..... 104/111, 89; 248/287, 248/323; 198/861.1, 860.3

[56] References Cited

U.S. PATENT DOCUMENTS

| | | | |
|---|---|---|---|
| 1,366,944 | 11/1920 | Ritchie, Jr. | 104/111 |
| 1,653,769 | 12/1927 | Johnson | 104/111 |
| 3,072,072 | 1/1963 | McDonough | 104/111 X |
| 3,436,047 | 4/1969 | Foltz | 104/111 X |
| 3,739,904 | 6/1973 | Windstrup | 198/204 |
| 3,854,688 | 12/1974 | Shuford | 248/316 A |
| 3,929,078 | 12/1975 | Sears | 104/111 |
| 4,471,867 | 9/1984 | Forshee | 104/111 X |
| 4,646,647 | 3/1987 | Spoler et al. | 104/111 |
| 4,982,835 | 1/1991 | Butler et al. | 198/860.3 X |
| 5,078,250 | 1/1992 | Cole | 198/860.3 |

FOREIGN PATENT DOCUMENTS

| | | | |
|---|---|---|---|
| 2510272 | 9/1976 | Fed. Rep. of Germany | 104/111 |

OTHER PUBLICATIONS

"Websters New World Dictionary Third College Edition"; Simon and Shuster Inc.; New York; 1988; pp. 257-258.

*Primary Examiner*—Robert J. Oberleitner
*Assistant Examiner*—S. Joseph Morano
*Attorney, Agent, or Firm*—Longacre & White

[57] ABSTRACT

An improved method and system of suspending an overhead conveyor rail from an existing structure which may or may not have horizontal structural members. A system of universal beams, brackets, connectors and bracing is arranged to suspend a conveyor rail from the existing structural members without drilling or welding. By the fact that only a few common, universal pieces are necessary, a cost effective system to manufacture and install is made possible.

21 Claims, 26 Drawing Sheets

SUSPENSION SUPPORT SYSTEM FOR AN OVERHEAD CONVEYOR SYSTEM WITH CLAMP TYPE CONNECTORS WHICH DO NOT PENETRATE EXISTING STRUCTURE

BACKGROUND OF THE INVENTION

1. Field of the Invention

The instant invention is directed to a system for suspending a conveyor rail from an existing structure.

2. Description of Related Art

Overhead conveyor systems and monorail systems are typically supported by two basic methods, column type and suspension type support systems.

Column support type systems are supported from the floor by various methods of arrangements of columns and beams. This type of support system is somewhat limited in its application. Support columns are restricted in their locations by the physical geometry of the structure in which the conveyor is being used and by the location of equipment, walkways and other various obstructions, thus limiting the conveyor layout.

Suspension type systems are suspended from above the conveyor. This type of support system allows the area below the conveyor to be left free of obstructions. Like the column supported type system, the conveyor layout is also restricted by the physical geometry of the surrounding structure, however, it is not restricted by obstacles at floor level. This allows for a great deal of flexibility in the conveyor layout.

The suspension type support system is traditionally more expensive than the column supported type system from an installation standpoint. This is largely due to installation work often being performed at high levels above the floor and the widely varying conditions encountered in this type of support system.

In the past, suspension type support systems have not always been considered due to their expense of installation. The obvious benefits of obstruction free space below the conveyor and the increased flexibility of the conveyor layout are often outweighed by the degree of difficulty in system design and installation and the inherently higher initial cost.

SUMMARY OF THE INVENTION

This invention provides an improved suspension type support system for an overhead conveyor system or similar apparatus.

This invention provides a method of suspension utilizing commonly available materials arranged in a manner such that the suspension system can be easily manufactured and installed. This results in significant reductions in: the materials required in manufacturing such a system, the manufacturing costs as a consequence of using common parts and brackets, and the installation costs through the use of brackets which are easily installed at high levels above the floor.

This invention further provides that by means of the common parts and brackets, which will be described in this disclosure, an overhead conveyor or similar apparatus can be securely and permanently suspended from the structure surrounding it, without the necessity of welding to the existing structural members or drilling holes in the existing structural members for bolt connections.

It is an object of this invention that the basic theory of the invention as a whole or separately can easily be adapted and modified for a wide variety of applications.

It is further the object of this invention that basic suspension members and brackets in a vertical plane collectively form a single point of suspension and that along the path of the conveyor or similar apparatus, this grouping of suspension members and brackets may be repeated at intervals in order to provide adequate support for the continuous length of the conveyor.

Further objects, advantages and features of this invention will appear in the following disclosure and description including the accompanying drawings.

BRIEF DESCRIPTION OF THE DRAWINGS

FIGS. 14*a* and 14*b* are orthogonal elevation views of the basic arrangement of the track beam bracket.

DETAILED DESCRIPTION OF INVENTION

Figure 1A:
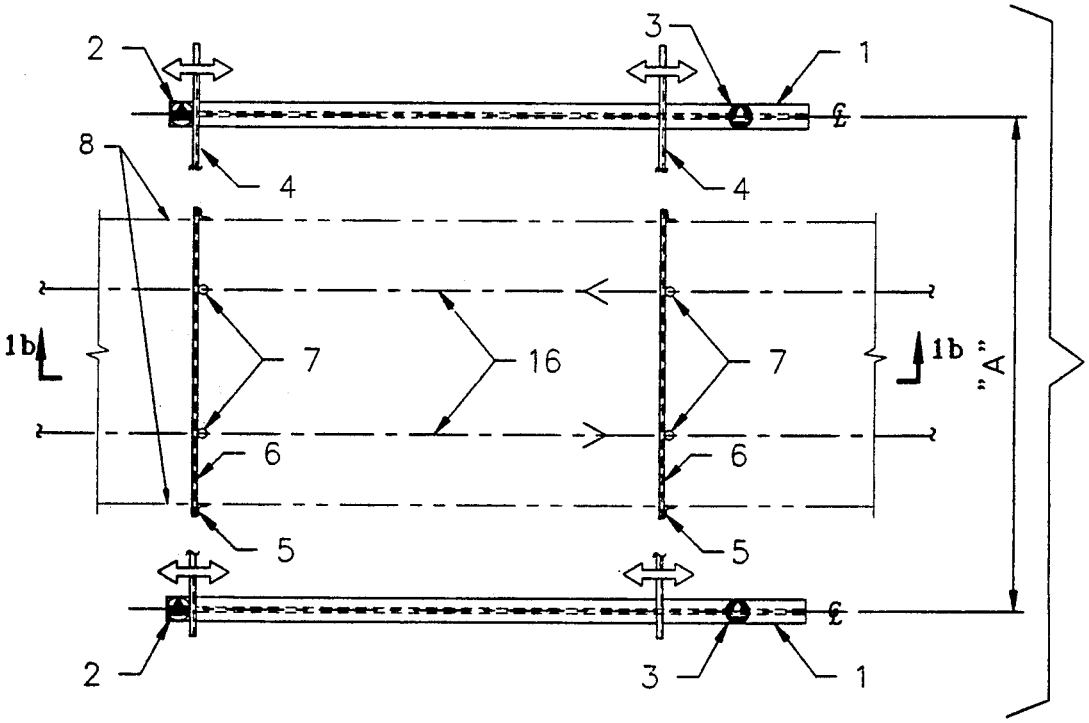
FIGS. 1*a*, 1*b* and 1*c* are a plan and corresponding sectional views of a segment of an overhead conveyor line utilizing the improved suspension type support system.
Figure 1B:
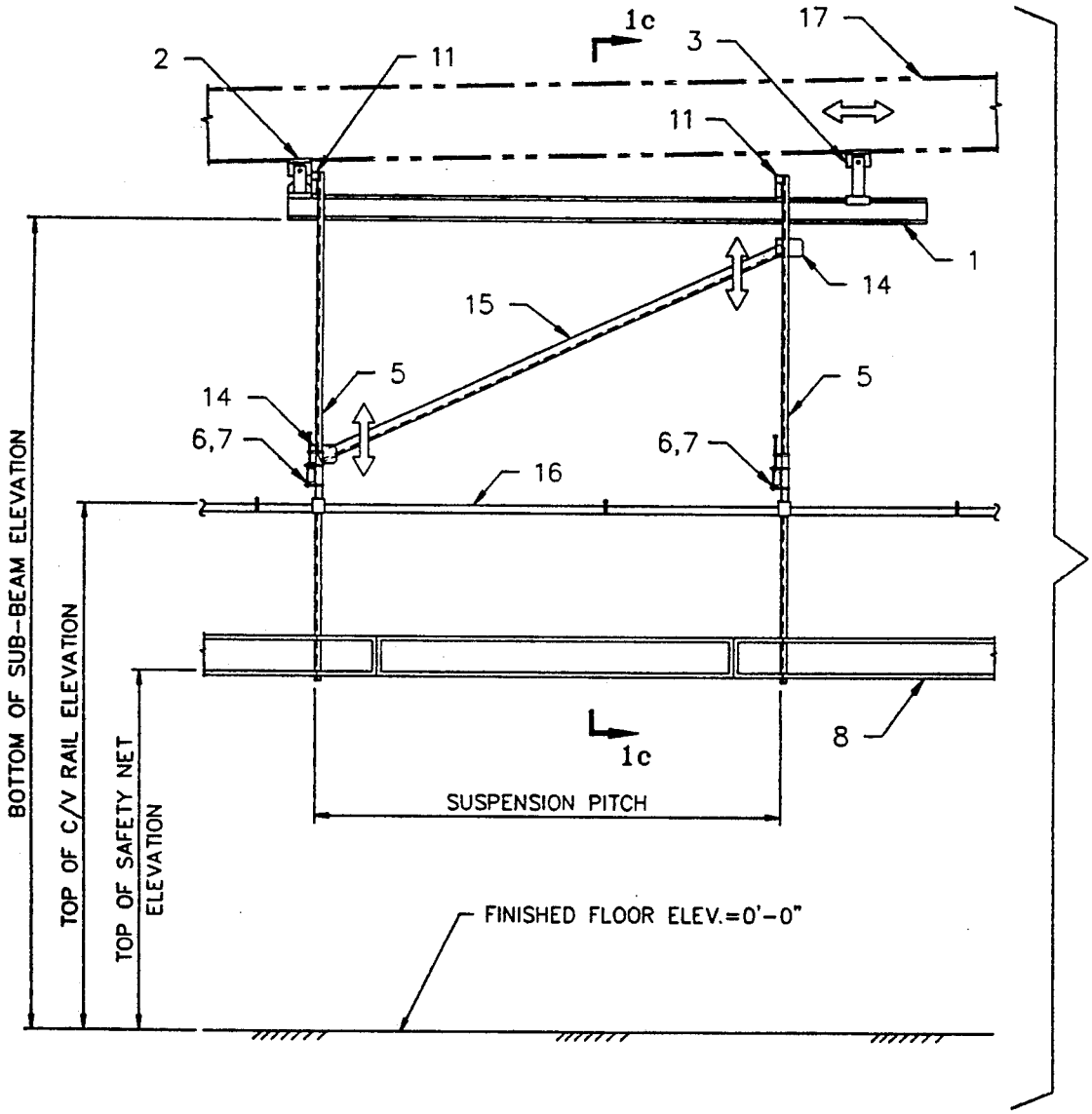
Figure 1C:
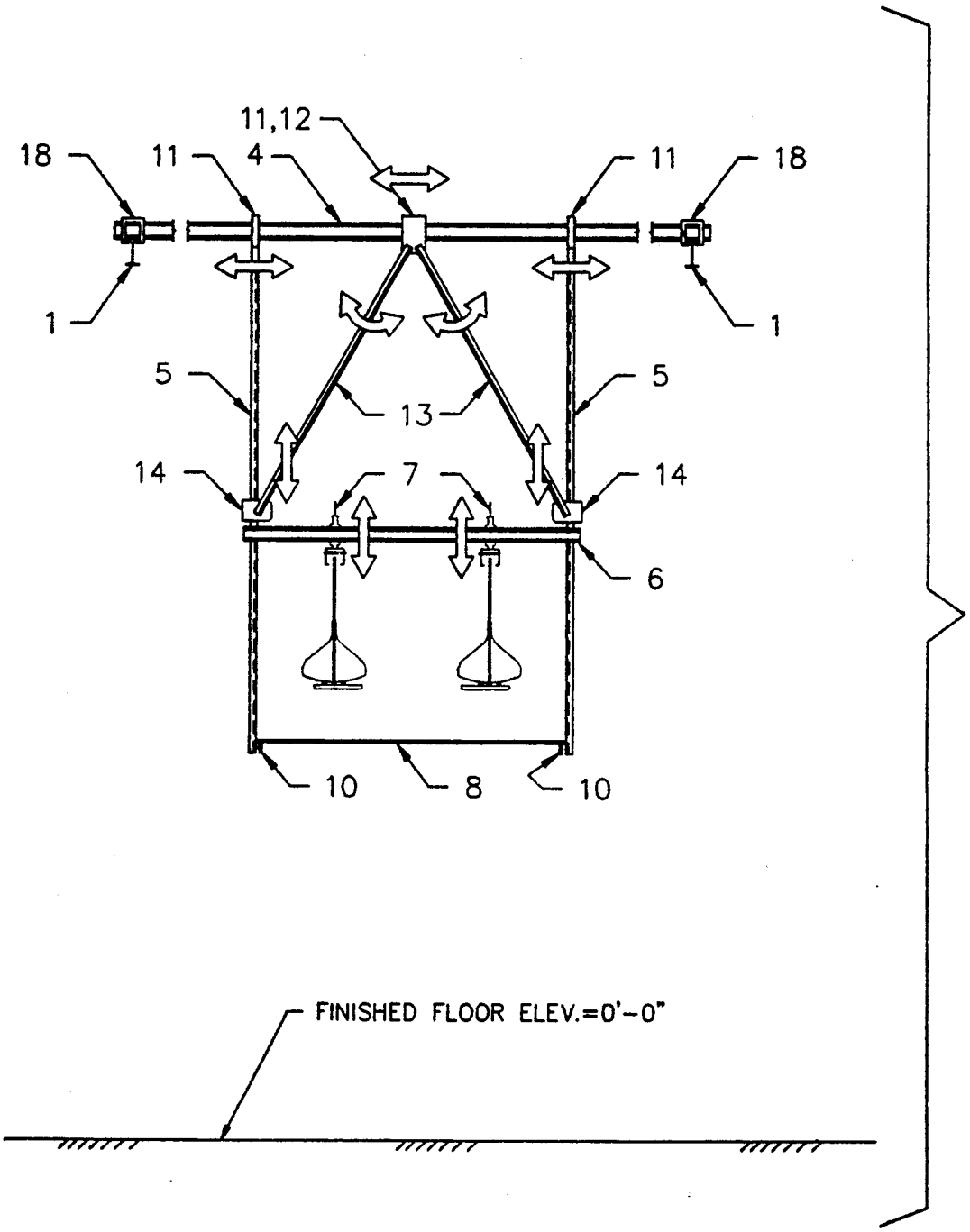

FIGS. 1*a*, 1*b* and 1*c* show a segment of an overhead conveyor line suspended by means of the improved suspension system and representing two suspension points along the path of the conveyor. The improved suspension system will be described in detail in the following disclosure.

The sub-beam 1 is suspended from and directly below the existing structural member 17 by means of the fixed girder bracket 2 and the sliding girder bracket 3.

Dimension "A" (FIG. 1*a*), representing the center to center distance between two adjacent sub-beams 1, is determined by the spacing of the existing structural members relative to the desired location of the conveyor rails 16. Mounted across the top flanges of the sub-beams 1, and spanning across both sub-beams 1, are the track beams 4 (FIGS. 1*a* and 1*c*). The track beams 4 are located perpendicular to the conveyor lines 16 and the sub-beams 1 at the desired location of a point of suspension. The track beams 4 are connected to the sub-beams 1 by means of the track beam connector 18. Suspended from the track beams 4 by means of a track beam bracket 11 are the vertical suspension members 5. Spanning across the vertical suspension members 5, and connecting by bolted connection, are the horizontal suspension members 6. Mounted on the horizontal suspension members 6 are the adjustable suspension brackets 7 from which the conveyor rail 16 is suspended.

In the case that a safety net 8 is required below the conveyor, the vertical suspension members 5 are extended beyond the horizontal suspension member 6. The safety net 8 is connected to the vertical suspension members 5 by means of the safety net connector 10.

FIG. 1*b* shows a diagonal type anti-sway brace 15 which is connected to vertical suspension members 5 at the upper and lower ends by means of the sliding bracing connector 14.

FIG. 1*c* shows V-type anti-sway bracing 13 which is connected at the upper end to the track beam 4 by means of the track beam bracket 11 and the bracing connector plate 12. V-type anti-sway type bracing 13 is connected to vertical suspension member 5 at the lower end by means of the sliding bracing connector 14.

FIGS. 2 through 6 demonstrate the flexibility of the improved suspension method and its ability to meet the requirements of a wide variety of applications and various arrangements.

Figure 2:
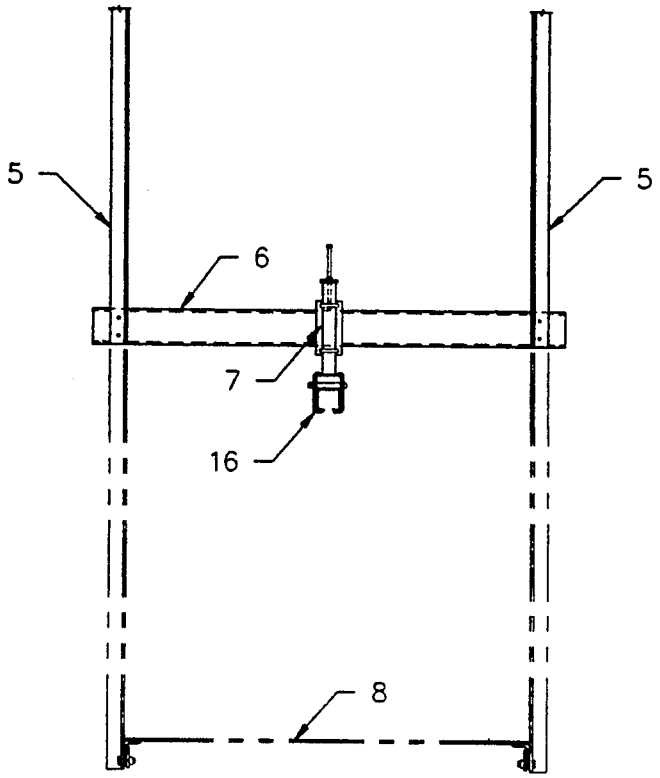
FIG. 2 shows the suspension of a single line overhead conveyor.

FIG. 2 shows a single line overhead conveyor suspended by vertical suspension members 5, horizontal suspension member 6 and the adjustable suspension bracket 7. Safety net 8 can be suspended below the conveyor rail 16 by extending vertical suspension members 5 as indicated.

Figure 3:
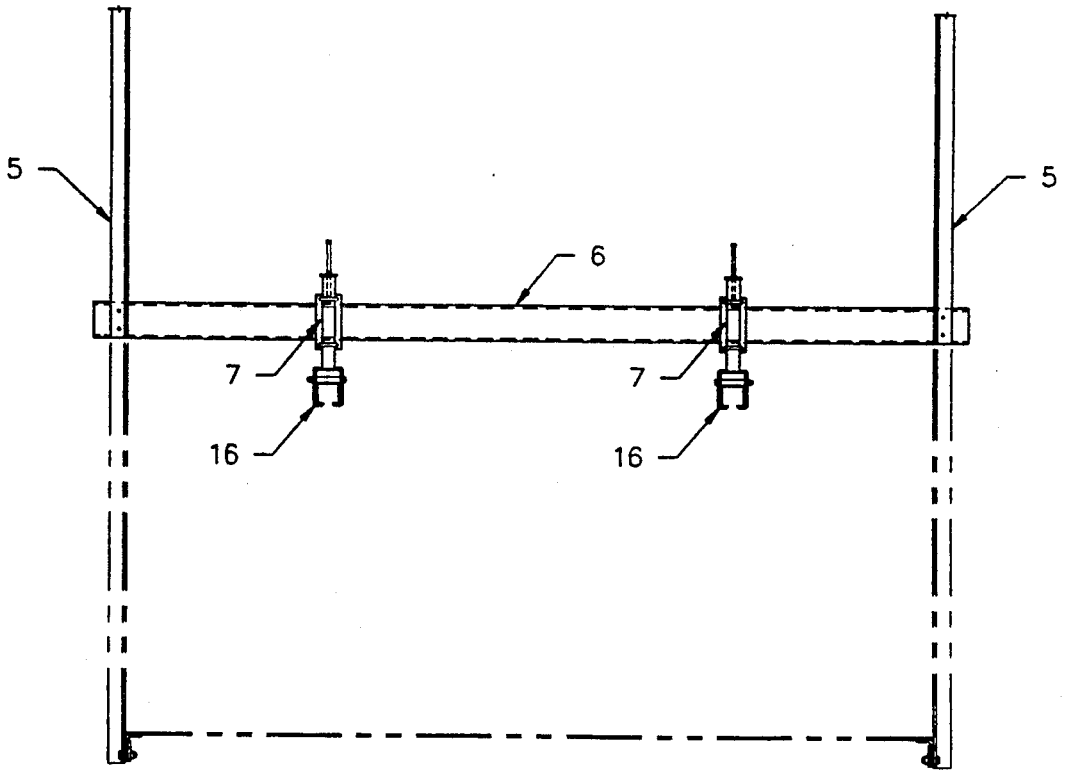
FIG. 3 shows the suspension of a double line overhead conveyor.

FIG. 3 shows a double line overhead conveyor suspended by the same basic members by increasing the length of horizontal suspension member 6 to allow sufficient space to mount two adjustable suspension brackets 7.

Figure 4:
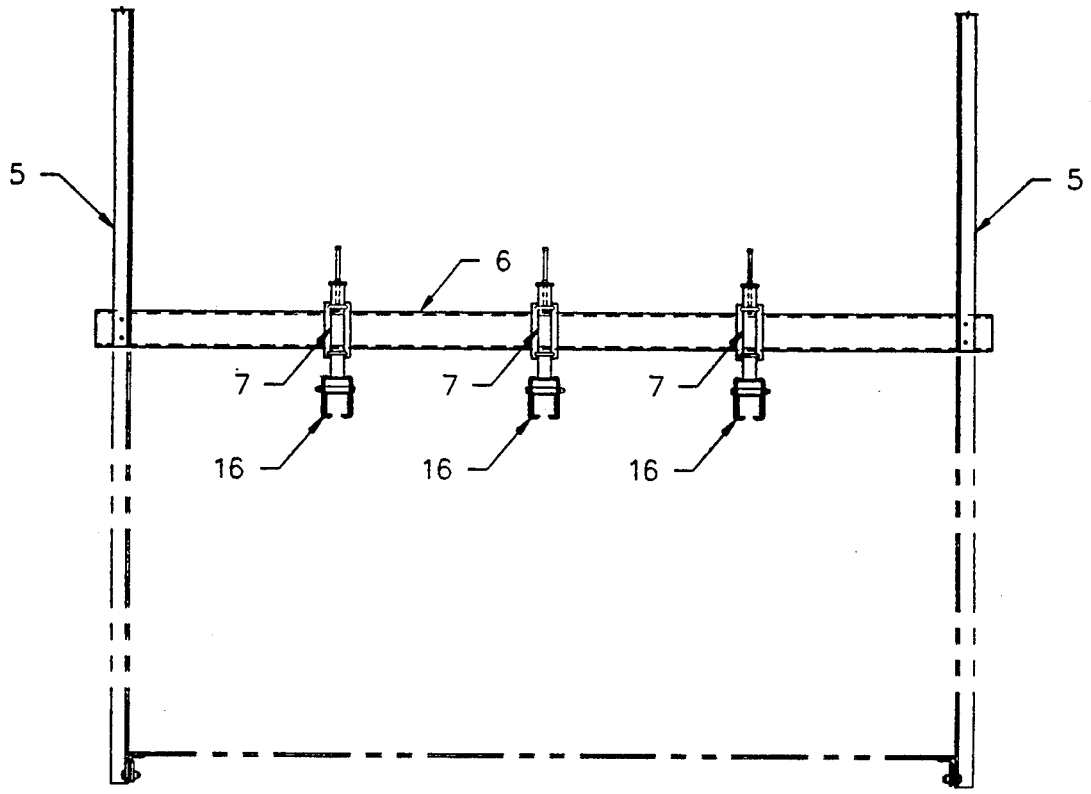
FIG. 4 shows the suspension of a multiple line overhead conveyor.

FIG. 4 shows a multiple line overhead conveyor suspended by the same basic method of suspension.

Figure 5:
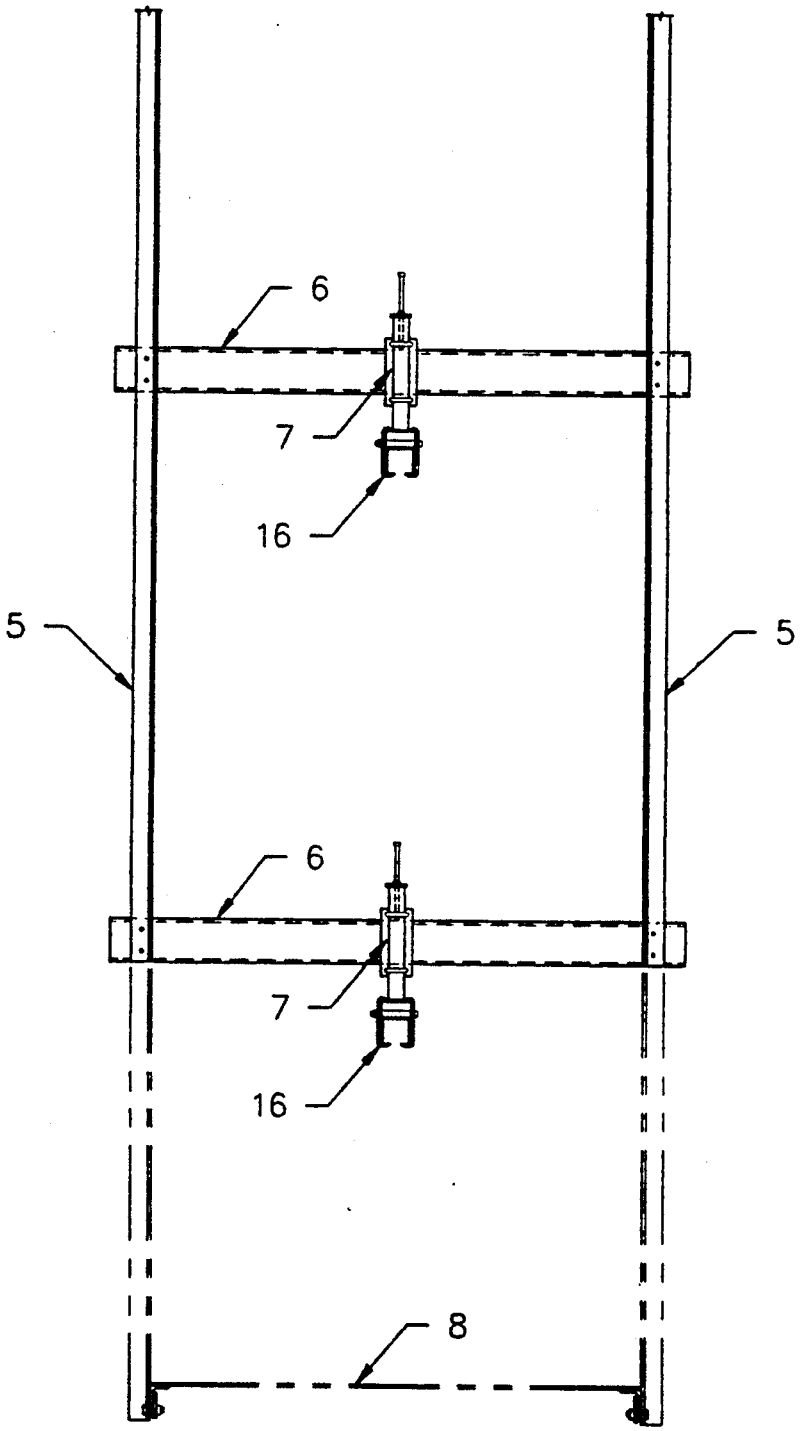
FIG. 5 shows the suspension of a stacked section of overhead conveyor.

FIG. 5 shows a stacked condition consisting of two single line overhead conveyors suspended by the same basic method of suspension by arranging two horizontal suspension members 6.

Figure 6:
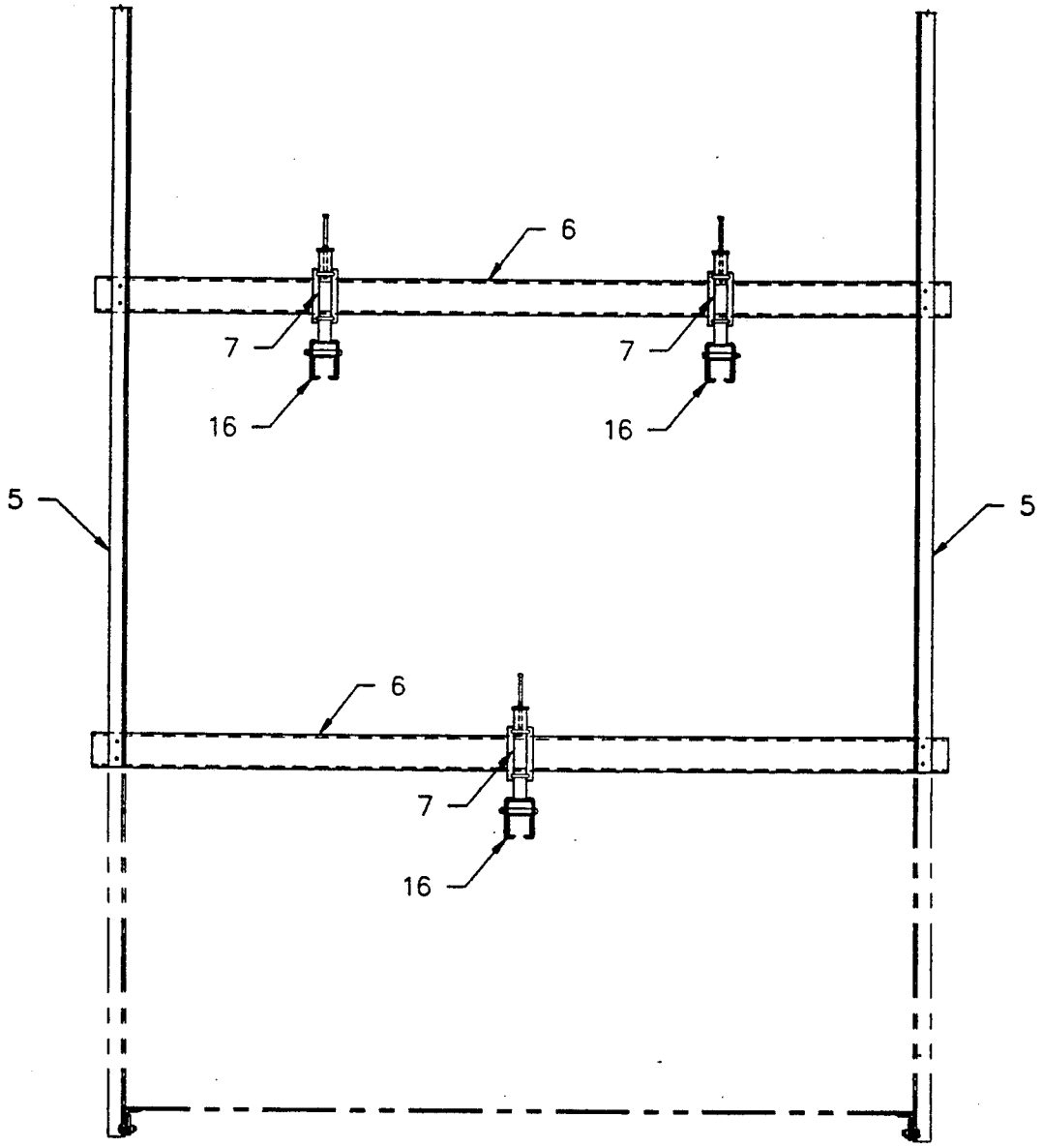
FIG. 6 shows the suspension of a stacked multiple section of overhead conveyor.

FIG. 6 shows another example of a stacked type suspension arrangement using the same basic method of suspension.

Figure 7A:
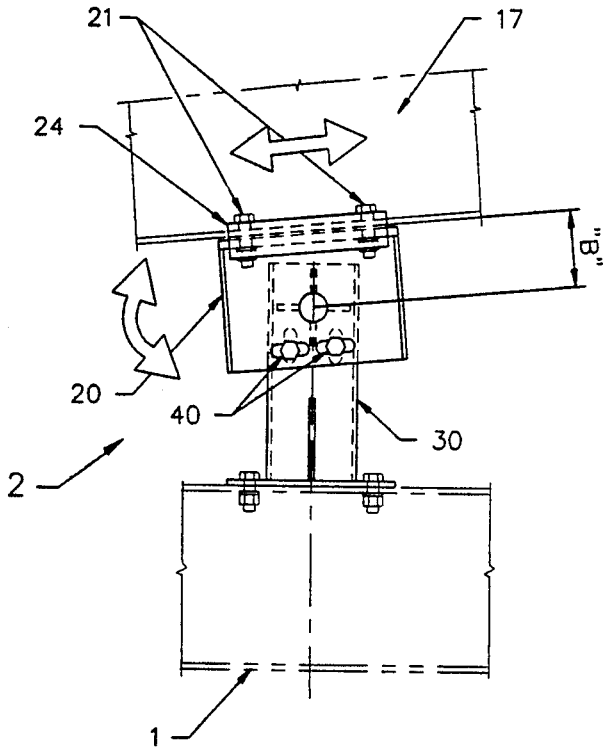
FIGS. 7*a* and 7*b* are orthogonal elevation views of the basic arrangement of the fixed girder bracket.
Figure 7B:
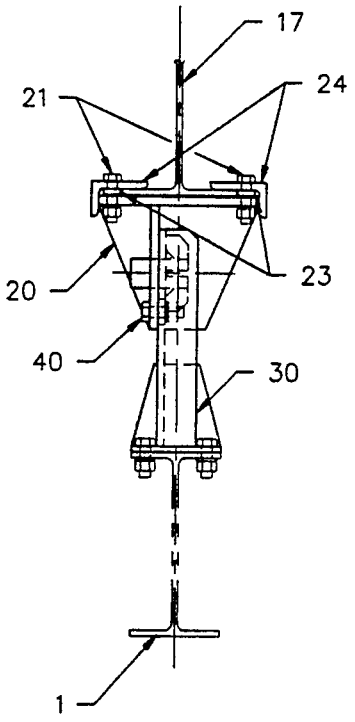

FIGS. 7*a* and 7*b* show the arrangement of the fixed girder bracket which connects the sub-beam 1 to an existing structural member 17.

In the installation of an overhead conveyor, which is suspended from the existing surrounding structure, codes often will not allow welding to existing structural members or drilling holes in existing structural members for the purpose of bolted connections. Consequently, these connections are often field fabricated connections and frequently must be reworked during installation due to unforeseen field conditions.

It is the object of this invention that by means of a clamping type pinned connection, the fixed girder bracket will adapt itself to any roof slope and will greatly reduce design and installation time required to suspend the sub-beam from the existing structural member 17.

Figure 8A:
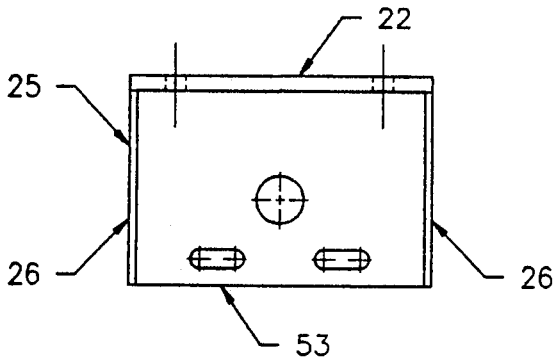
FIGS. 8*a* and 8*b* are orthogonal elevation views of the assembly upper unit for the fixed and sliding girder brackets.

The fixed girder bracket 2 is comprised of several basic parts. The upper unit 20 is in contact with the lower horizontal surface of the existing structural member 17 and is connected by means of bolts 21 which pass through holes in the cap plate 22 (FIG. 8*a*) of the upper unit 20 (FIGS. 7*a* and 7*b*), through upper round pipe spacers 23 and through the horizontal leg of upper clamp angles 24, thereby forming a clamping type bolted connection. The length of upper round pipe spacer 23 should be slightly less than the thickness of the lower horizontal surface of existing structural member 17, so as to create a secure clamping condition. Bolts 21 are to be tightened snug in order to allow the fixed girder bracket 2 to move horizontally along the bottom surface of the existing structural member 17 for precise locating.

Figure 9A:
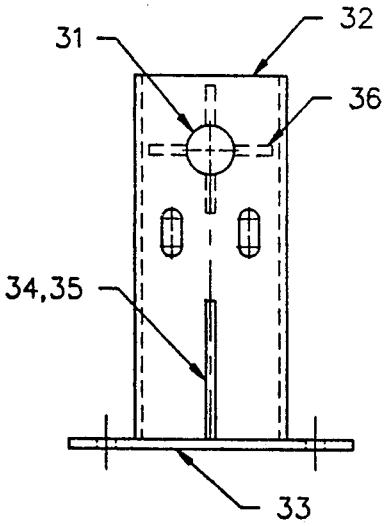
FIGS. 9*a* and 9*b* are orthogonal elevation views of the assembly lower unit for the fixed girder bracket.
Figure 9B:
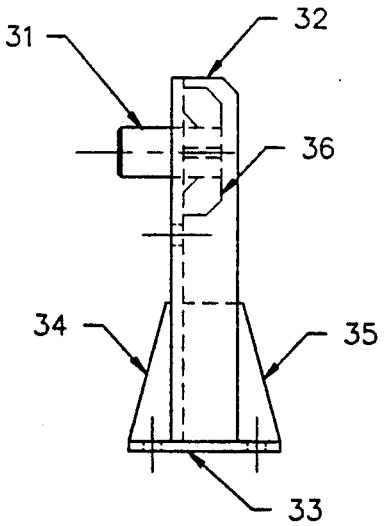

When the upper unit 20 is in place and secured, the lower unit 30 (FIGS. 7*a* and 7*b*) is installed by inserting pin 31 (FIGS. 9*a* and 9*b*) through the hole in vertical plate 25 (FIG. 8*a*) of upper unit 20 (FIGS. 7*a* and 7*b*).

When lower unit 30 is in place, bolts 40 are inserted and tightened snug connecting the upper unit 20 and lower unit 30. Through the use of slotted holes in upper unit 20 and lower unit 30, this bracket can pivot around the pin 31 in order to adapt to the slope of the existing structural member 17 (FIG. 7*a*).

When the fixed girder bracket 2 has been precisely located and adjusted, all bolts are tightened until lock washers are fully compressed, then bolt projections past nuts are painted with thread filling paint to prevent loosening.

Figure 8B:
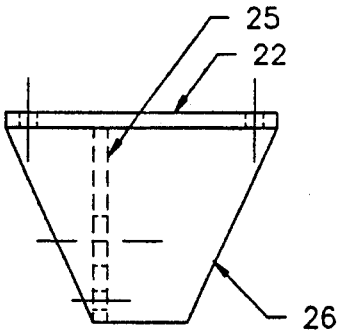

With regard to the upper unit 20 (FIGS. 8*a* and 8*b*), in addition to the vertical plate 25 and cap plate 22, end plates 26 are included at each end for added rigidity and to assure perpendicularity between plates 25 and 22. The upper unit may be of continuous welded construction. The hole in vertical plate 25 corresponds to the diameter of pin 31.

With regard to the lower unit 30 (FIGS. 9*a* and 9*b*), a vertical member 32 of structural channel is welded to a base plate 33 with stiffener plates 34 and 35 on either side for added rigidity and to assure perpendicularity between vertical member 32 and base plate 33. Pin 31 projects through vertical member 3 and is welded in place from the back side by means of four stiffener tabs 36 which are welded to the pin 31 and the vertical member 32 to add rigidity and assure perpendicularity between pin 31 and vertical member 32. The two slotted holes in vertical member 32 correspond to the slotted holes in the vertical plate 25 (FIG. 8*a*) for bolts 40 (FIGS. 7*a* and 7*b*). The holes in base plate 33 (FIGS. 9*a* and 9*b*) are for a matched connection on the upper horizontal surface of sub-beam 1 (FIG. 7*a*).

The upper clamp angles 24 (FIGS. 7*a* and 7*b*) are adaptable to work with any standard wide flange shaped or plate girder existing structural member 17. The length of the horizontal leg can be increased or decreased to suite the physical dimensions of the existing structural member 17.

The size of bolts and the thickness of members are determined by the designer to meet the requirements of the specific application of this invention and as per standard engineering practice.

Figure 10A:
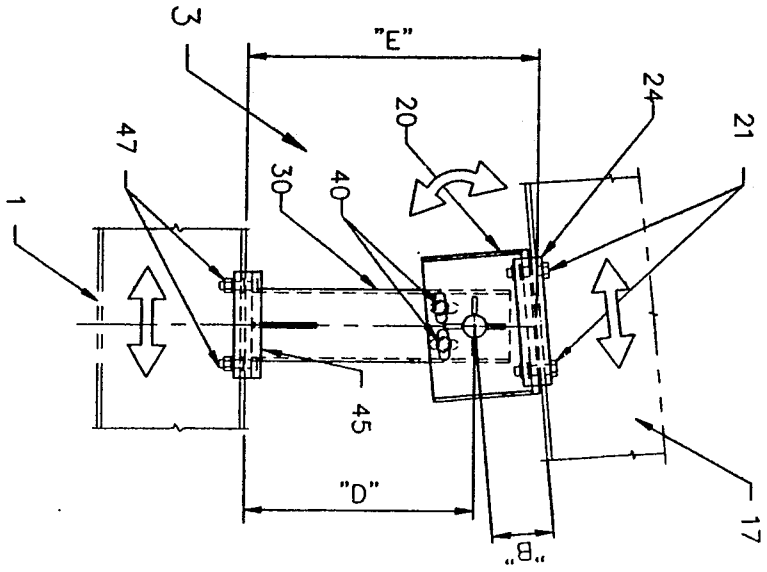
FIGS. 10*a* and 10*b* are orthogonal elevation views of the basic arrangement for the sliding girder bracket.
Figure 10B:
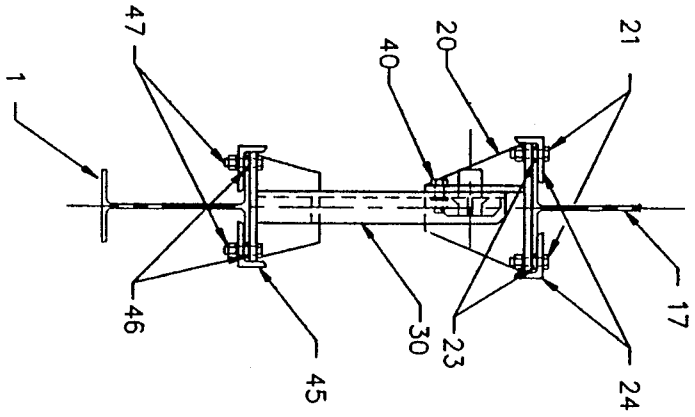

FIGS. 10 and 10*b* show the arrangement of the sliding girder bracket 3 which connects the sub-beam 1 to an existing structural member 17.

The sliding girder bracket 3 is comprised of several basic parts (elements which correspond to those of the fixed girder bracket 2 use identified with the same numerals):

1) The upper unit 20 (FIGS. 10*a* and 10*b*)
2) Upper clamp angles 24
3) Upper round pipe spacers 23
4) The lower unit 30
5) Lower clamp angles 45, and
6) Lower round pipe spacers 46.

The upper unit 20, upper clamp angles 24, and upper round pipe spacers 23 are identical to those of the fixed girder bracket 2.

It is the object of this invention that a sub-beam 1 (FIG. 10*a*) can be suspended from an existing structural member 17 at one end by a fixed girder bracket 2 and at the opposite end by means of a sliding girder bracket 3 which is movable along both the lower horizontal surface of the existing structural member 17 and the upper horizontal surface of the sub-beam 1. By the movement of the sliding girder bracket 3 in one direction or the other, the elevation of the sub-beam 1 can be increased or decreased. In FIG. 1*b*, note that movement of the sliding girder bracket 3 to the right will increase the elevation of sub-beam 1. Movement of the sliding girder bracket 3 to the left will decrease the sub-beam elevation.

The sliding girder bracket 3 connects to the existing structural member 17 by means of a clamping connection as previously disclosed with respect to the fixed girder bracket 2.

The upper unit 20 and lower unit 30 are connected by means of bolts 40 as previously disclosed with respect to the fixed girder bracket 2.

Figure 11A:
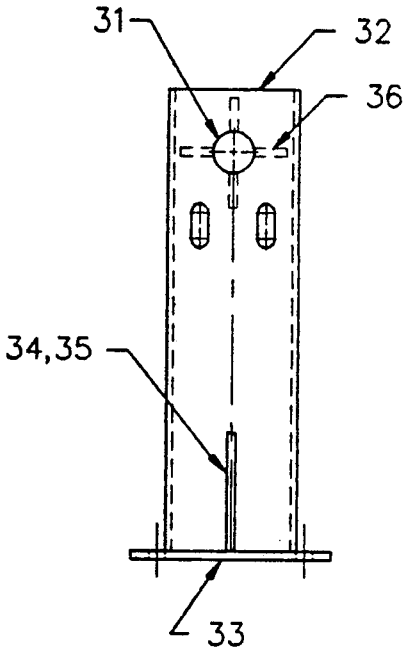
FIGS. 11*a* and 11*b* are orthogonal elevation views of the assembly lower unit for the sliding girder bracket.
Figure 11B:
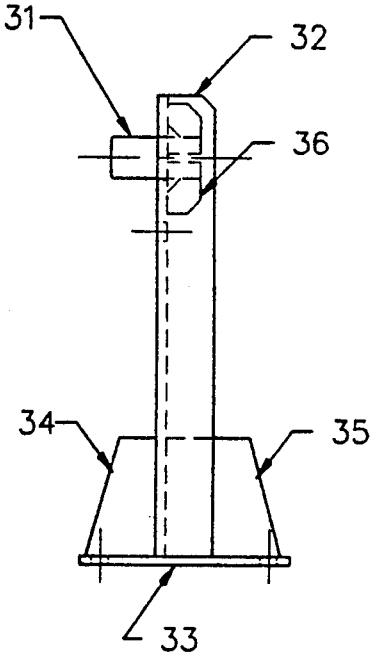

The lower unit 30 is connected to the sub-beam 1 by means of bolts 47 (FIG. 10) which pass through holes in base plate 33 (FIGS. 11*a* and 11*b*), through the lower round pipe spacers 46 (FIG. 10*b*) and lower clamp angles 45 (FIGS. 10*a* and 10*b*) forming a clamping type bolted connection. The length of lower round pipe spacers 46 should be slightly less than the thickness of the upper horizontal surface of sub-beam 1.

After the sliding girder bracket has been moved into its precise location, all bolts are tightened until lock washers are fully compressed and then thread filling paint applied.

It is further an object of this invention that by altering the dimensions of the upper unit 20 and upper clamp angles 24, the fixed girder bracket 2 and the sliding girder bracket 3, can be adapted for use with open web bar joist and joist girders as well as welded trusses.

Figure 12A:
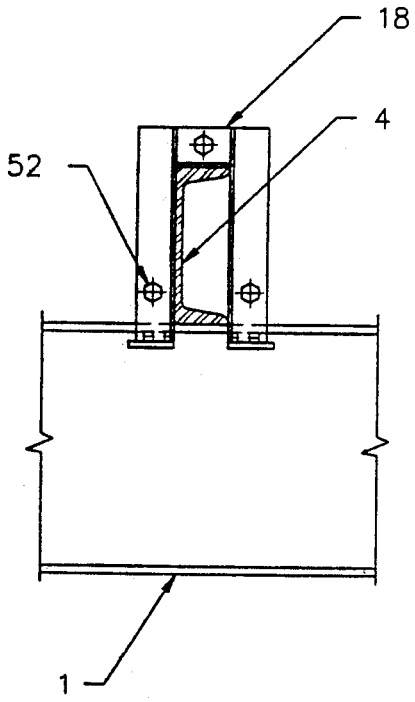
FIGS. 12*a* and 12*b* are orthogonal elevation views of the basic arrangement of the track beam connector.

FIG. 12 shows the connection of the track beam 4 to the sub-beam 1 by means of the track beam connector 18.

It is the object of this invention that the track beam 4 can be connected to the sub-beam 1 without the necessity of a matched bolted connection or field welding.

Figure 12B:
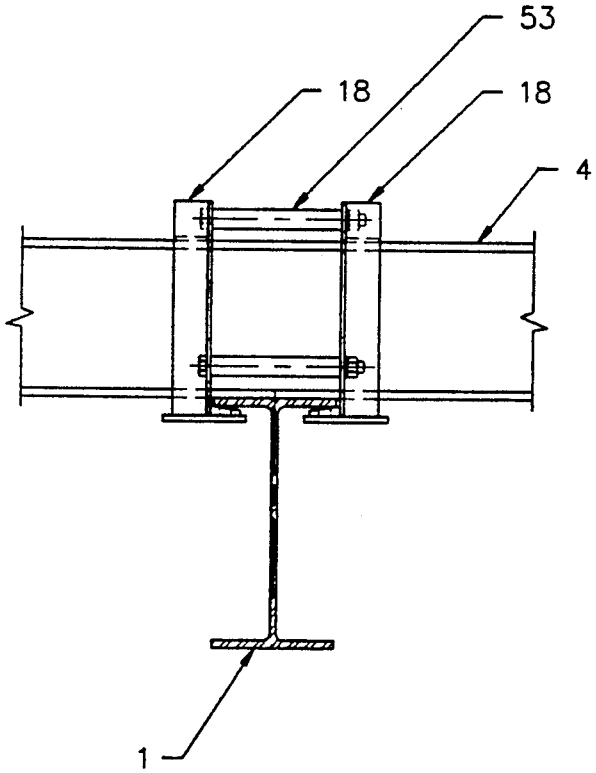
Figure 13A:
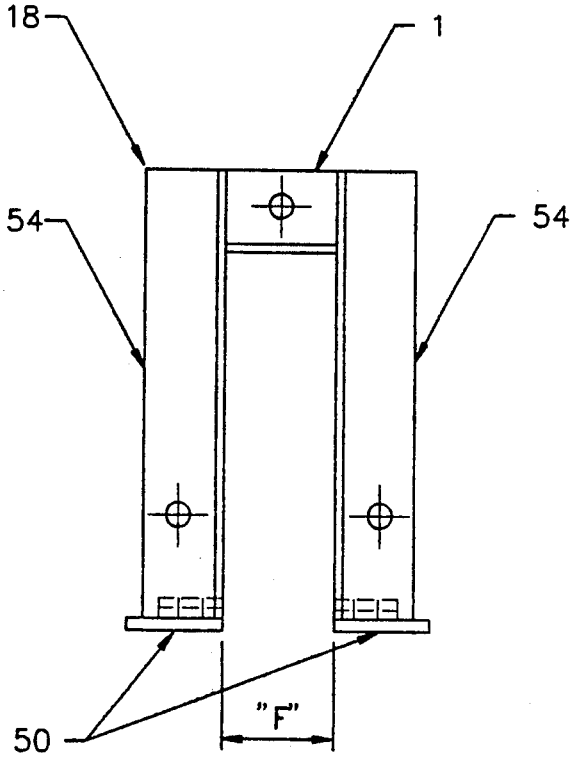
FIGS. 13*a*, 13*b* and 13*c* are orthogonal elevation views of the assembly of the track beam connector.
Figure 13B:
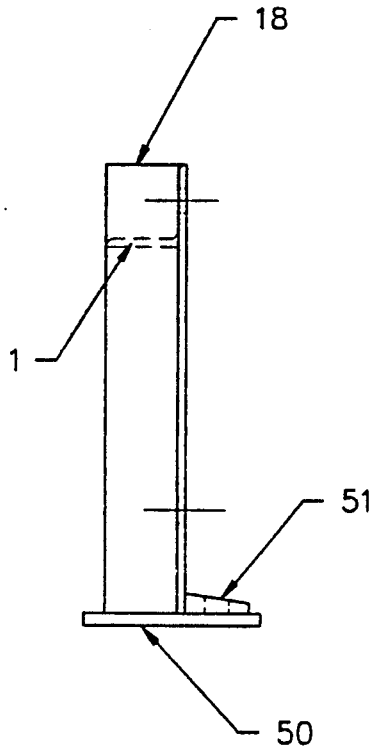
Figure 13C:
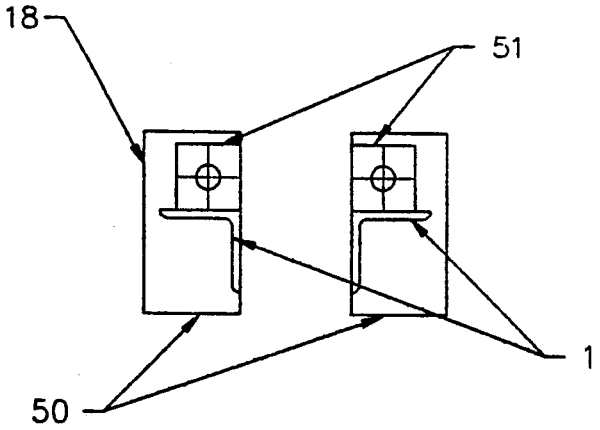

After the track beam 4 has been placed in its final position, the tack beam connector 18 is lowered on either side of the track beam 4 and moved until the base foot 50 (FIGS. 13*a*–13*c*) and beveled surface of washer 51 (FIG. 13*b*) are in place below the upper horizontal surface of sub-beam (FIG. 12*b*). Two track beam connectors 18 (FIG. 12*b*) are then connected by three bolts 52 which pass through round pipe spacers 53 forming a clamping type connection. As the bolts 52 are tightened, the face of beveled washer 51 contacts the upper horizontal surface of the sub-beam 1 forcing the connectors 18 downward creating a friction connection between the contacting surfaces of the sub-beam 1 and the track beam 4.

By altering the horizontal opening, dimension "F" (FIG. 13*a*) and the length of vertical straps 54, the track beam connector 18 is adaptable for any size channel or wide flange shape used for track beam 4.

By altering the length of round pipe spacers 53 and bolts 52, the bracket is adaptable for any size wide flange used for sub-beam 1.

FIGS. 14*a* and 14*b* show the assembly and general arrangement of the track beam bracket The vertical suspension member 5 is connected to the track beam bracket 11 by means of two through bolts 58. A seat angle 59 is welded to the inside of a bent plate 60 to provide a level bearing surface for the upper horizontal surface of the track beam 4.

The dimension "G" is determined by the width of material selected for track beam 4. It is recommended that dimension "G" equal the width of track beam 4 plus a slight clearance to allow the track beam bracket 11 to slide horizontally from side to side to achieve precise location of the vertical suspension member 5. It is further recommended that the length of seat angle 5 be slightly less than the width of track beam 4. A solid clamping connection is achieved due to seat angle 59 being welded at bent plate 60 and the length of seat angle 59 being slightly less than dimension "G".

The dimension "H" is equal to the width of material selected for vertical suspension member 5.

The dimension "I" is equal to the depth of material selected for track beam 4 plus one half the diameter of bolt size selected for through bolt 58 plus a slight clearance. It is recommended that the upper surface of the lower through bolt 58 be located slightly below the lower horizontal surface of track beam 4 in order to eliminate the possibility of a rocking type motion during installation.

Dimension "J" should be of length such that when added to dimension "I" equals a round number for dimension "K" which will simplify the manufacturing process for both the track beam bracket 11 and the vertical suspension member 5.

The procedure for installation of the track beam bracket 11 is as follows:

(1) After the track beam 4 has been installed and is securely in place, the track beam bracket 11 is lowered over the upper horizontal surface of the track beam 4 until the seat angle 59 is in a bearing position.

(2) The track beam bracket 11 can then be moved horizontally along the upper horizontal surface of the track beam 4 to the approximate final location.

(3) The vertical suspension member 5 can then be lifted into place and bolted to the track beam bracket with through bolts 58. The through bolts 58 should be tightened snug in order that the track beam bracket 11 can be moved horizontally along with the vertical suspension member 5.

(4) The vertical suspension member 5 and the track beam bracket 11 are then moved into precise location and the through bolts 58 are tightened until lock washers are fully compressed. Thread filling paint is then applied to the bolt projections past the nuts to prevent loosening.

The thickness of bent plate 60 and a straight plate 61, as well as the diameter of bolts 58 are to be determined by the designer to meet the specific application of this invention and as per standard engineering practice.

The physical dimensions of the track beam bracket 11 may be modified to meet the size requirements of the material selected for the track beam 4.

Figure 23A:
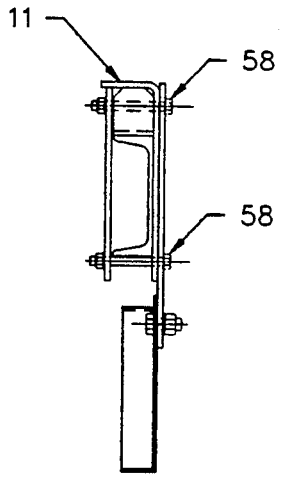
FIGS. 23*a* and 23*b* are orthogonal elevation views of the basic arrangement of the bracing connector plate.
Figure 23B:
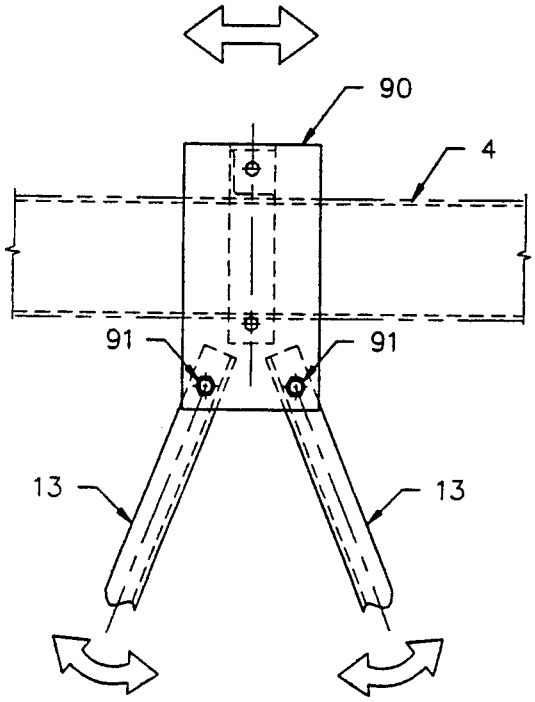

The track beam bracket may be used for a number of applications; one of which is described in accordance with FIGS. 23*a*, 23*b* and 24 in which the track beam bracket 11 is used in conjunction with the V-type anti-sway bracing 13.

Figure 15A:
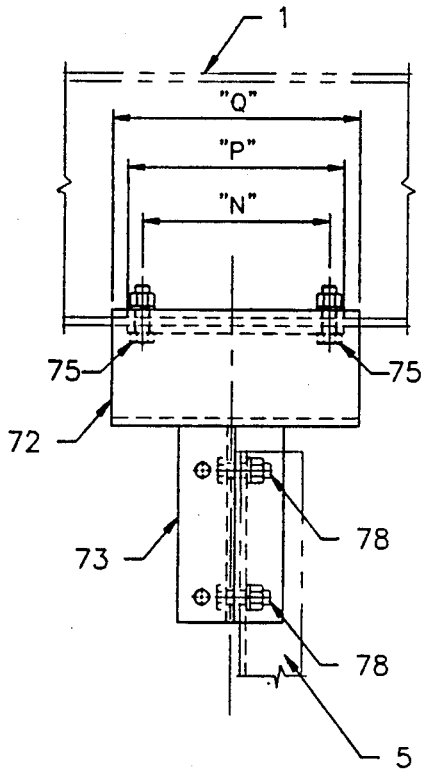
FIGS. 15*a* and 15*b* are orthogonal views of the basic arrangement of the sub-beam bracket.
Figure 15B:
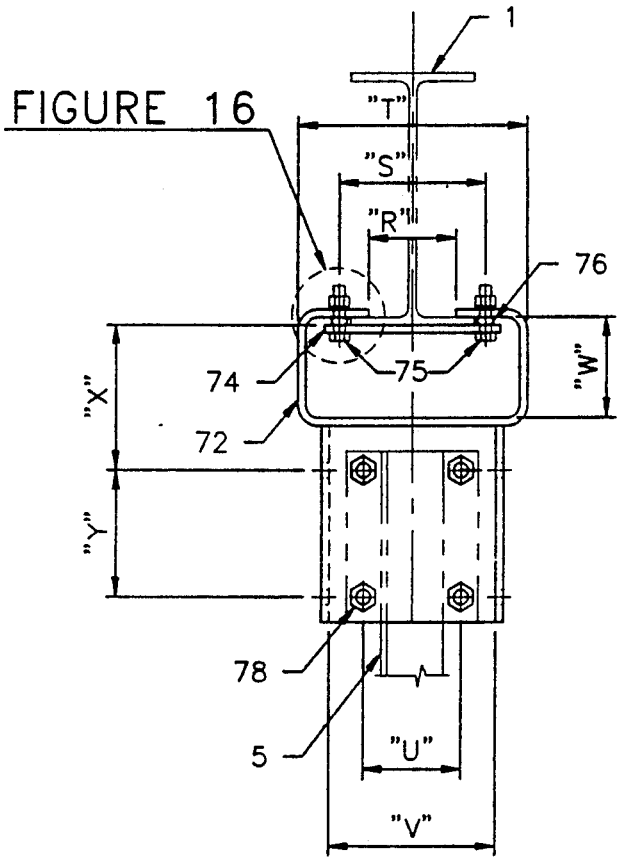

FIGS. 15*a* and 15*b* show a sectional view and side view of a vertical suspension member 5 connecting to a sub-beam 1 by means of a sub-beam bracket assembly 70.

Figure 17A:
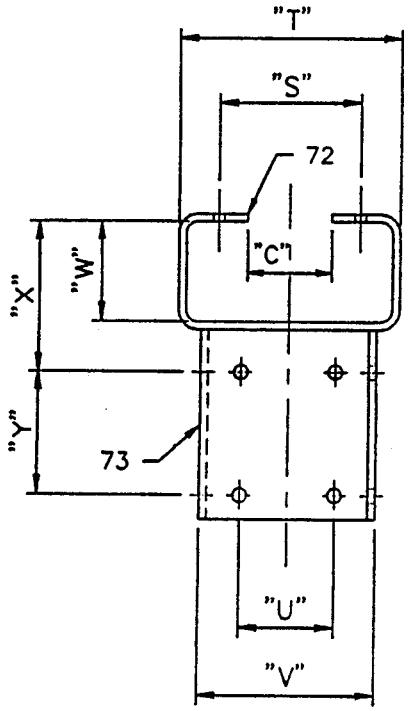
FIGS. 17*a* and 17*b* are orthogonal elevation view of the assembly of the sub-beam bracket.

The sub-beam bracket assembly 70 is comprised of three major elements:

(1) The sub-beam bracket 71 (FIGS. 17*a* and 17*b*) consists of bent upper plate 72 and a lower plate 73 extending in a vertical plane. The basis for physical dimensions indicated will be described in the following disclosure.

Figure 18A:
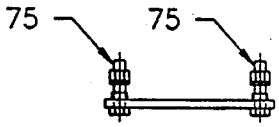
FIGS. 18*a* and 18*b* are orthogonal views of the assembly of the clamp plate for the sub-beam bracket.

(2) A clamp plate 74 (FIGS. 18*a* and 18*b*) has four holes through which four bolts 75 pass. The bolts 75 are welded in place. The basis for physical dimensions indicated will be described in the following disclosure.

(3) Round pipe spacers 76 (FIG. 16) of diameter "M". Dimensions to be described in following disclosure.

Figure 16:
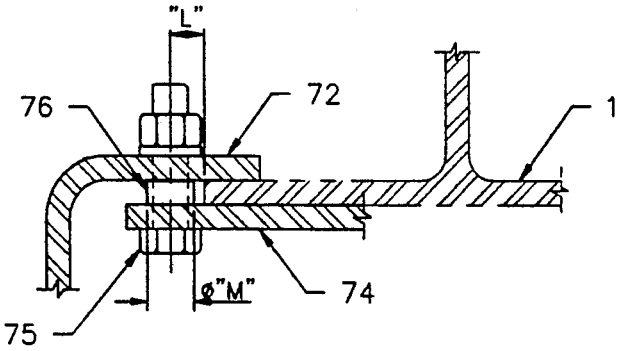
FIG. 16 is an enlarged detail pertaining to the sub-beam bracket shown in FIG. 15*b*.

FIG. 16 indicates the bottom flange of a sub-beam 1 which is a standard wide flange shape. The diameter of bolt 75 is to be determined by the designer to meet the specific application of this invention as per standard engineering practice.

The diameter "M" of round pipe spacer 76 is determined by:

(1) The diameter of bolt 75 which establishes the minimum inside diameter.

(2) The wall thickness chosen for the round pipe spacer 76. It is recommended that the spacer wall be of sufficient thickness so as to prevent collapsing the spacer when tightening, or pulling the spacer through the hole in sub-beam bracket assembly 70.

The height of round pipe spacer 76 is determined by the flange thickness of material chosen for sub-beam 1 less a slight clearance so as to create a secure clamping condition and preventing deformation of either the sub-beam bracket 71 or the clamp plate 74.

Dimension "L" (FIG. 16), the distance from center of bolt 75 to the toe of the flange of sub-beam 1 equals one half diameter "M" plus a slight clearance.

Figure 17B:
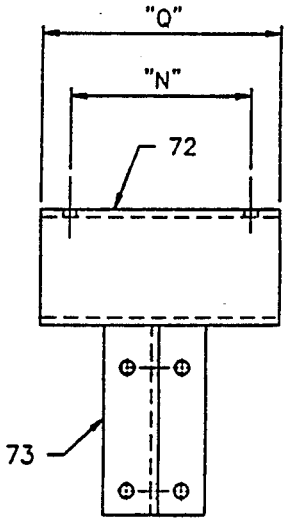
Figure 18B:
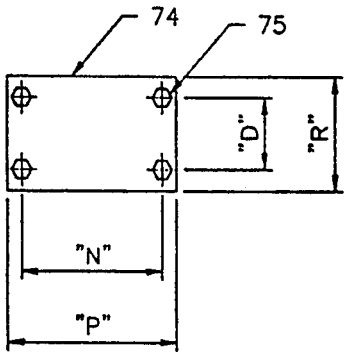

The dimension "S" center to center of holes for bolts 75 in FIGS. 15*b*, 17 and 18*b* is determined by the flange width of material chosen for sub-beam 1 plus two times dimension "L" (FIG. 16).

Figure 19:
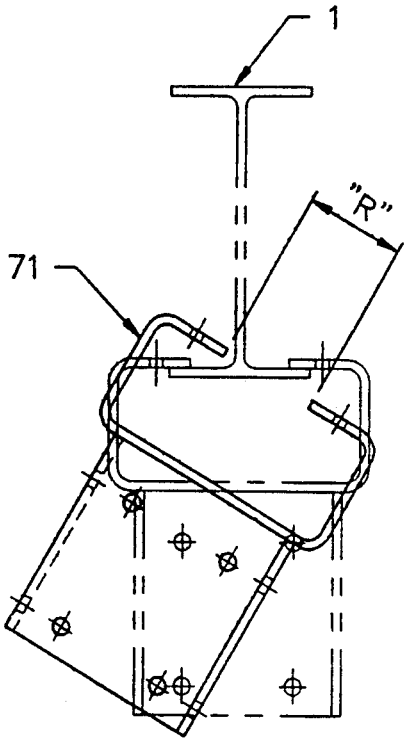
FIG. 19 is installation procedure for sub-beam bracket.

The width dimension "R" of clamp plate (FIG. 18*b*) is determined by the dimension "S" plus the minimum edge distance for holes for bolts 75 as per standard engineering practice. The dimensions "N", "P" and "Q" FIGS. 15*a*, 17*b* and 19 are to be determined by the designer to meet the requirements of the specific application of this invention and as per standard engineering practice.

The dimension "T" (FIGS. 15*b* and 17*a*) should be of enough length as to provide sufficient clearance between the edge of clamp plate 74 and the inside vertical surface of sub-beam bracket 71.

The dimension "W" (FIGS. 15*b* & 17*a*) should be of enough length as to provide sufficient clearance as to insert and lift by hand the clamp plate 74.

Figure 20:
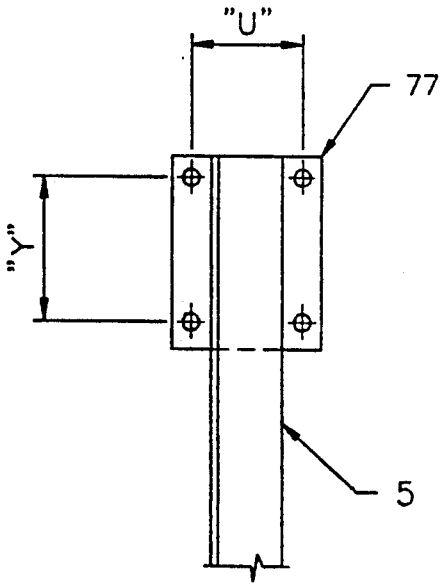
FIG. 20 is an illustration of the upper portion of vertical suspension member.

The dimension "R" (FIGS. 15*b*, 18*b* and 19) should be of sufficient length as to allow the sub-beam bracket 71 to be slipped around the bottom flange of the sub-beam 1 (FIG. 19) while allowing sufficient area of surface contact between sub-beam bracket 71 and the bottom flange of sub-beam 1. The vertical dimensions "X" and "Y", and horizontal dimensions "U" and "V"(FIGS. 15*b* & 17*a*) are to interface with bolt plate 77 (FIG. 20) of the vertical suspension member 5.

The procedure for operation of the sub-beam bracket is as follows:

(1) Slip sub-beam bracket 71 around bottom flange of sub-beam 1 as indicated at FIG. 19.

(2) Insert clamp plate 74 (FIG. 15*b*) with round pipe spacers 76 in place, into opening in sub-beam bracket 71 and lift until bolts 75 pass through the holes in sub-beam bracket 71.

(3) Install lockwashers and nuts for bolts 75 and tighten snug so that the sub-beam bracket 71 can be moved horizontally for precise location.

(4) Lift vertical suspension member 5 (FIG. 15*b*) into place and bolt to lower plate 73 of sub-beam bracket 71 with retaining bolts 78.

(5) After precise location has been achieved, tighten all bolts until lock washers have been fully compressed, then paint bolt projections past the nuts with thread filling paint to prevent loosening.

The basic physical dimensions of the parts of this invention can be altered in order that the bracket may be used for any size wide flange sub-beam.

The thickness of materials and the size of members and bolts are established by the designer to meet the requirements for the specific application of the invention and as per standard engineering practice.

Figure 21:
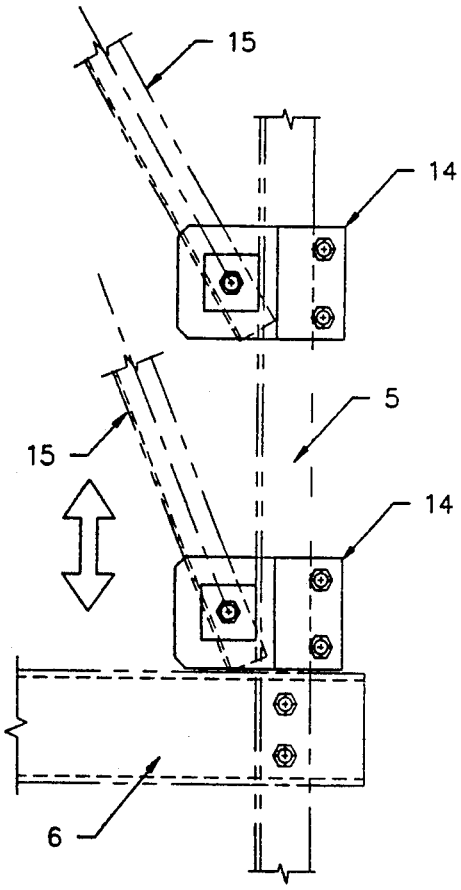
FIG. 21 is the basic arrangement of the sliding bracing connector.

FIG. 21 shows an elevation view of the sliding bracing connector 14 which connects diagonal type anti-sway brace 15 to the vertical suspension member 5 at a point near it's intersection with the horizontal suspension member 6.

It is the object of this invention that by vertical movement in an upward or downward direction, the sliding bracing connector 14 can change the angle of inclination of diagonal type anti-sway brace 15. The advantage being that many vertical braces throughout a total project, which previously would have been unique pieces due to slightly different lengths, can now be made identically to simplify manufacturing, and greatly reduce manufacturing cost.

It is another object of this invention that the diagonal type anti-sway brace 15 can be installed without cutting or welding in the field, thereby greatly reducing installation cost.

Figure 22:
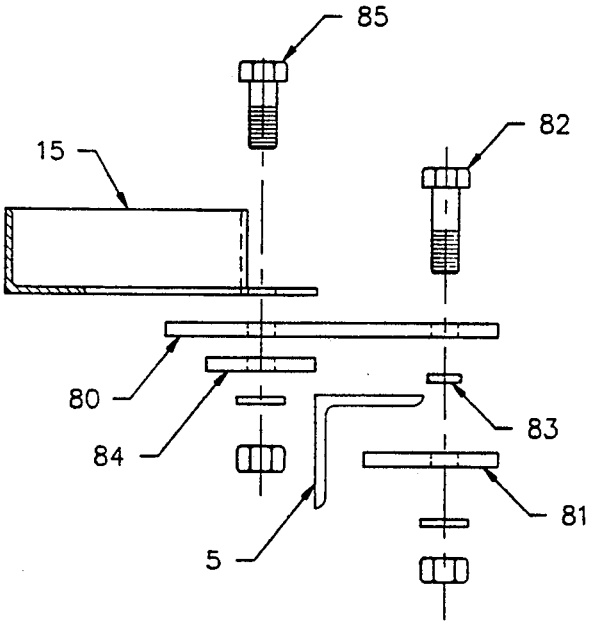
FIG. 22 is an exploded view of the assembly of the sliding bracing connector.

FIG. 22 shows an exploded view of the basic elements of the sliding bracing connector 14. The bracing connector plate 80 contacts the vertical suspension member 5. The bracing clamp plate 81 contacts the vertical suspension member 5 on the opposite side, and provides a clamping type connection by means of two bolts 82. Between bracing connector plate 80 and bracing clamp plate 81 are two round pipe spacers 83 through which clamping bolts 82 pass. The length of round pipe spacers 83 should be slightly less than the thickness of material chosen for the vertical suspension member 5. The wall thickness of round pipe spacer 83 should be thick enough to prevent collapse of spacer under tightening and to avoid being pulled through the holes under tightening.

Stopper plate 84 is connected to the bracing connector plate 80 on the side opposite the diagonal type anti-sway brace 15 by means of pivot bolt 85. Stopper plate 84 contacts both the bracing connector plate 80 and the vertical suspension member 5 in order to prevent rotation of the sliding bracing connector 14 after installation.

The procedure for installing of the sliding bracing bracket 14 is as follows:

(1) After an upper connection of diagonal type anti-sway brace 15 has been made, bracing connector plate 80 and stopper plate 84 are bolted to the diagonal type antisway brace 15 by means of pivot bolt 85, which is tightened snug in order to allow bracing connector plate 80 to rotate about pivot bolt 85.

(2) Rotate the diagonal type anti-sway brace 15 around the upper connection point until it is in the approximate position of alignment with vertical suspension member 5.

(3) Insert clamping bolts 82 through holes in bracing connector plate 80 and through round pipe spacers 83, install bracing clamp plate 81 and tighten clamping bolts 82 until snug in order to allow movement vertically of the bracket and brace.

(4) Move the diagonal type anti-sway brace 15 into proper location and force downward to apply tension.

(5) Tighten all bolts until lock washers are fully compressed, then paint bolt projections past the nuts with thread filling paint to prevent loosening.

It is the object of this invention that with this method of bracing and with the use of the sliding bracing connector 14, anti-sway bracing can be manufactured and installed at a greatly reduced cost.

Sizing of members and bolts are to be established by the designer to meet the requirements for the specific application of this invention and as per standard engineering practice.

FIGS. 23*a*, 23*b*, 24*a* and 24*b* show the upper bracing connector for V-type anti-sway bracing 13 using the track beam bracket 11 and attachment connector plate 90. The track beam bracket is installed over the track beam 4 as described previously. The through bolts 58 are used to connect the attachment connector plate 90, through bolts 58 are tightened snug to allow the track beam bracket 11 and attachment connector plate 90 to slide horizontally along the track beam 4. The track beam bracket 11 is then moved to the approximate center between vertical suspension members 5 and V-type anti-sway bracing 13 is lifted into place and connected to attachment connector plate 90 by means of attachment bolts 91, and tighten snug so as to allow V-type anti-sway bracing 13 to rotate around attachment bolts 91. When the sliding bracing connector 14 has been installed at the lower end of V-type anti-sway bracing 13, bolts 58 and 91 are tightened until lock washers are fully compressed, then bolt projections past the nuts are painted with thread filling paint to prevent loosening.

Figure 24A:
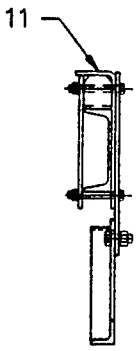
FIGS. 24*a* and 24*b* are orthogonal elevation views of the basic arrangement of "V" type bracing.
Figure 24B:
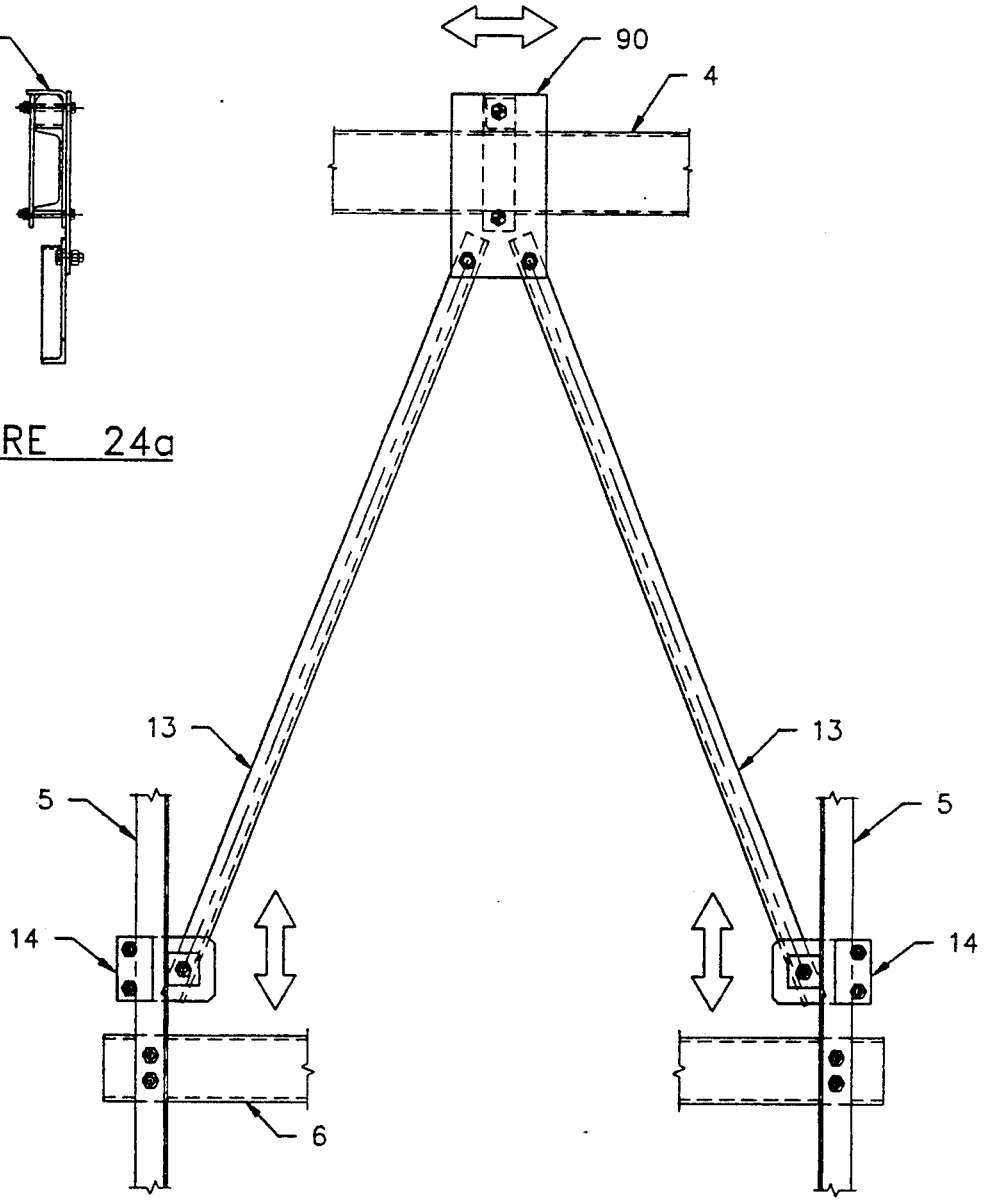

FIGS. 24*a* and 24*b* shows a typical bracing bay for V-type antisway bracking 13 in which the bracking 13 is connected to the track beam 4, at the upper end by means of the track beam bracket 11 and attachment connector plate 90. V-type anti-sway bracing 13 is connected at the lower end to the vertical suspension member 5 near its intersection with horizontal suspension member 6 by means of sliding bracing connector 14.

Figure 25:
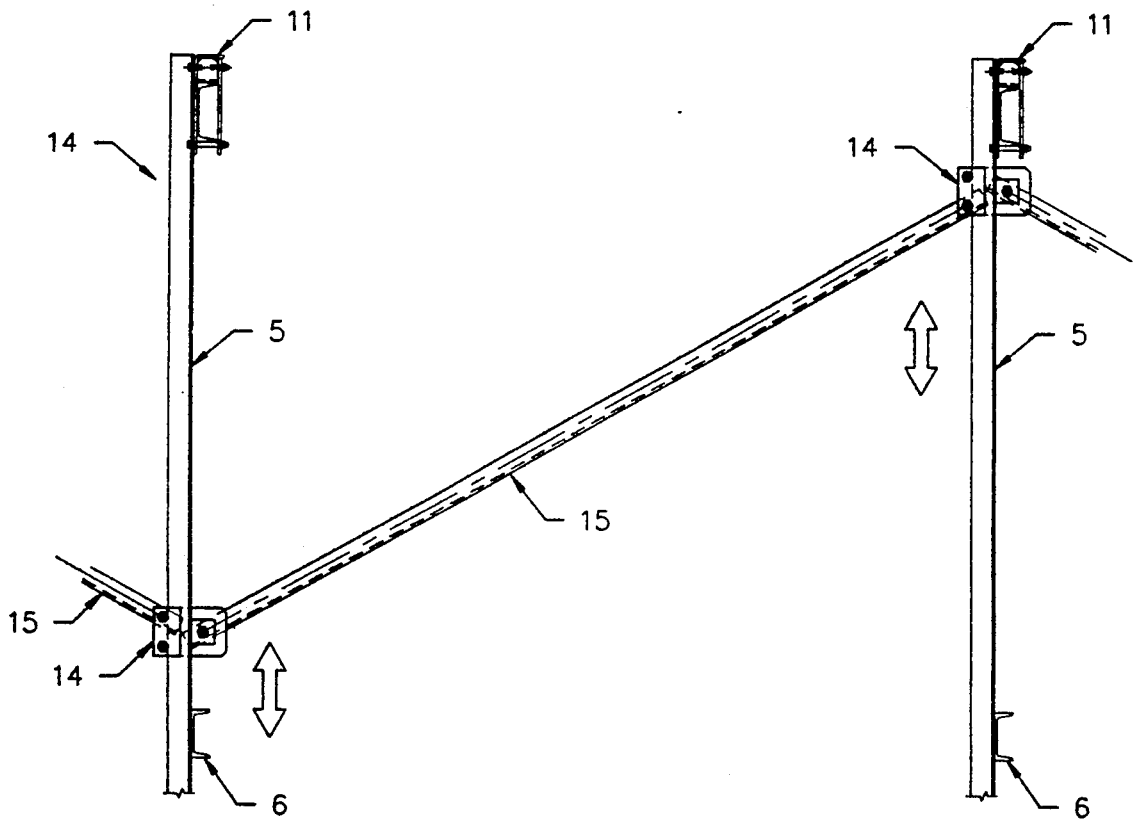
FIG. 25 is the basic arrangement of "Diagonal" type bracing.

FIG. 25 shows a typical bracing bay for diagonal type antisway bracing 15 in which the bracing 15 is connected to the vertical suspension member 5 near it's intersection with track beam 4, at the upper end, by means of the sliding bracing connector 14. Diagonal type anti-sway bracing 15 is connected to the adjacent vertical suspension member 5 near it's intersection with horizontal suspension member 6 at the lower end by means of the sliding bracing connector 14.

Figure 26A:
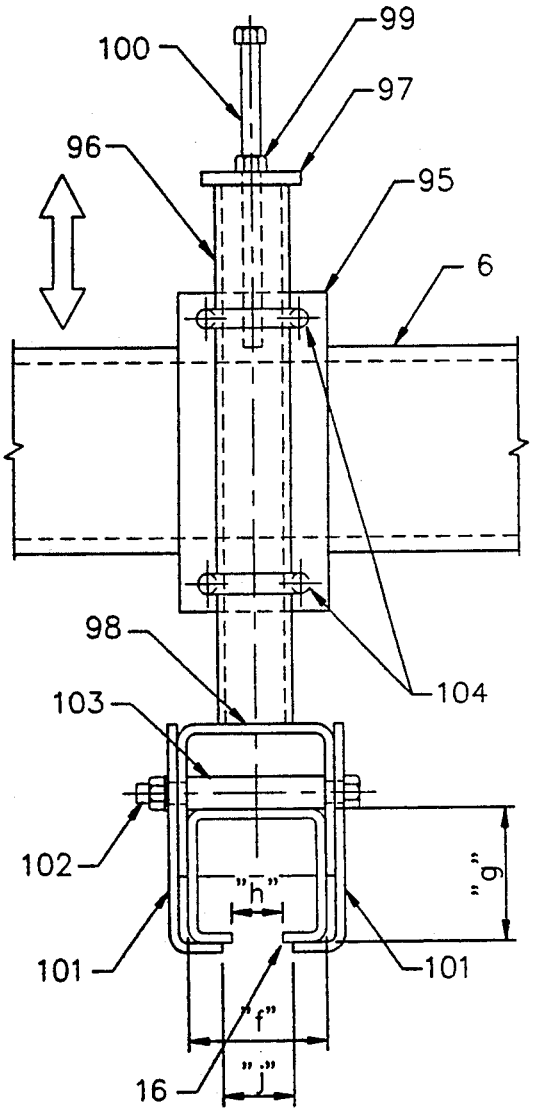
FIGS. 26*a* and 26*b* are orthogonal elevation views of the basic arrangement of the adjustable suspension bracket in horizontal positioning.
Figure 26B:
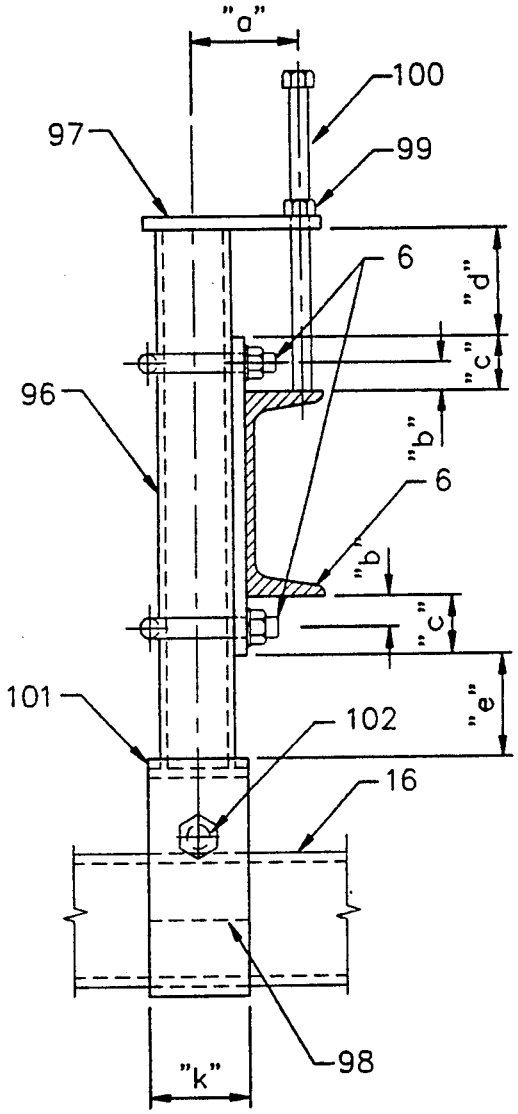

FIGS. 26*a* and 26*b* show the assembly and basic arrangement of the adjustable suspension bracket 7. Located on the horizontal suspension member 6 and fixed in place by welding, is a mounting plate 95. A round pipe 96 with a cap 97 and a bent saddle plate 98 form an adjustment shaft. The cap 97 is welded to the round pipe 96 at its upper end and has one through hole. Welded to the top of the cap 97 and centered on the through hole, is a standard hex nut 99. Threaded through the hex nut 99 and passing through the hole in the cap 97, is an adjustment bolt 100 of sufficient length to provide the maximum upward and downward adjustment as will be described in the following disclosure. The bent saddle plate 98 is welded to the round pipe 96 at the lower end. There are two through holes located on bent saddle plate 98. Mounting on either side of bent saddle plate 98 are clamp fingers 101 which envelope the conveyor rail 16 without obstructing the open slot, dimension "h", on the lower horizontal face of the conveyor rail 16. Each of the clamp fingers 101 have a hole which aligns with the holes through the bent saddle plate 98 and through which passes a finger bolt 102. Located inside bent saddle plate 98, is a round pipe spacer 103 through which finger bolt 102 also passes.

When finger bolt 102 is tightened, the clamp fingers 101 are forced together surrounding the bent saddle plate 98 and conveyor rail 16. The length of round pipe spacer 103 should be slightly less than the inside dimension "f" of the bent saddle plate 98 so as to allow a firm clamping connection while preventing the bent saddle plate 98 being compressed enough to deform the conveyor rail 16.

Two U-bolts 104 surround the round pipe 96 and pass through the four holes in the mounting plate 95. The length of the threaded projections of the U-bolts 104 should be such that a nut and lock washer can be installed on the side of the mounting plate 95 opposite the round pipe 96.

The diameter of the round pipe 96 should be designed with sufficient cross sectional area as to support the weight of the conveyor rail and material being conveyed as per standard engineering practice. The diameter of round pipe 96 establishes the minimum inside diameter of the U-bolts 104 which further establishes the center to center dimension (horizontally) of the holes in mounting plate 95. It is recommended that the inside diameter of the U-bolts 104 be equal to the outside diameter of round pipe 96 in order to maximize the area of surface contact between U-bolts 104 and round pipe 96 when tightened. The diameter of the U-bolts 104 is to be determined as per standard engineering practice.

The dimension "b" for bolt tightening clearance above and below the horizontal suspension member 6, are established by the diameter of U-bolts 104 as per standard engineering practice. Dimension "c" above and below horizontal suspension member 6 is established by dimension "b" plus the minimum edge distance for holes as per standard engineering practice.

Dimension "d" is the maximum downward adjustment. Dimension "e" is the maximum upward adjustment, both are determined by the designer to meet the requirements of the specific application of this invention.

Figure 28:
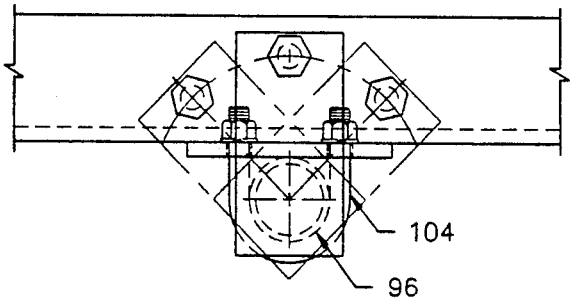
FIG. 28 is a plan view of the adjustable suspension bracket illustrating it's rotation ability.

Dimension "a" from center line of round pipe 96 to center line of adjustment bolt 100 is determined by the diameter of round pipe 96 and the physical dimension of the material selected for horizontal suspension member 6. It is recommended that dimension "a" be of enough length that adjustment bolt 100 is clear of the upper U-bolt 104 so as to allow rotation of round pipe 96, refer to FIG. 28, allowing for greater flexibility in the application of this invention. The clear opening at the lower horizontal face of the adjustable suspension bracket 7, dimension "j", is to be determined by the designer to meet the requirements of the specific application of the invention. It is recommended that the horizontal leg at the lower end of clamp fingers 101 be of sufficient length as to provide adequate support of conveyor rail 16 while providing clearance for the open slot in the lower horizontal face, Dimension "h".

The width of bent saddle plate 98 and clamp fingers 101, dimension "k", is determined by the selected diameter of round pipe 96 and by the cross sectional area required to support the weight of the conveyor and material being conveyed as determined by standard engineering practice.

Figure 29A:
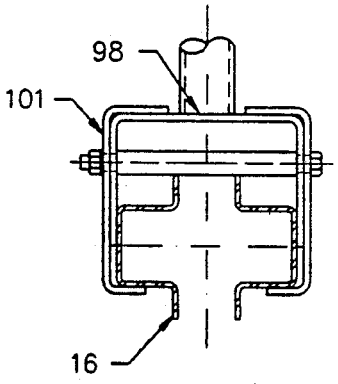
FIGS. 29*a*, 29*b* and 29*c* illustrate some of the practical uses of the adjustable suspension bracket.
Figure 29B:
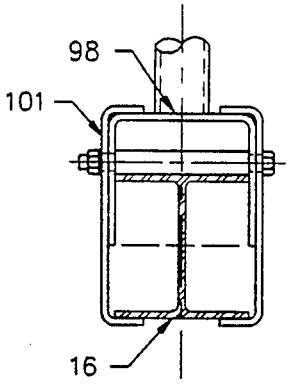
Figure 29C:
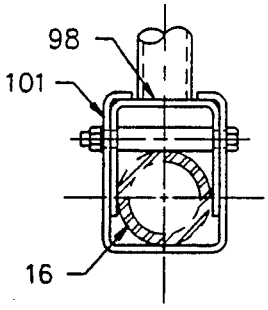

The invention can be adapted to virtually any size requirement by altering the values of dimensions "f" and "g" to meet the size requirements of the member to be supported. By altering the dimensions "f" and "g" and the profile of clamp fingers 101, the adjustable suspension bracket 7 can be adapted to support virtually any shape rail 16 as shown in FIGS. 29*a*–29*c*, and can be used for many applications other than the support of an overhead conveyor rail (e.g., support of a monorail).

The procedure for installation of the adjustable suspension bracket 7 is as follows:

(1) After the mounting plate 95 has been welded to the horizontal suspension member 6, the adjustment shaft consisting of items round pipe 96, cap 97, bent saddle plate 98, hex nut 99 and adjustment bolt 100) are connected by means of the two U-bolts 104. The adjustment bolt 100 should be set at a mid way position. The U-bolts 104 should be tightened snug so that the adjustment shaft can be moved in an upward or downward direction.

(2) Lift conveyor rail 16, or some other object to be suspended, into position and install round pipe spacer 103, clamp fingers 101 and finger bolt 102. Tighten finger bolt 102 until lock washer is fully compressed.

(3) Precise elevation or leveling is achieved by turning the adjustment bolt 100.

(4) After precise elevation has been achieved, tighten U-bolts 104 until all lock washers are fully compressed.

(5) After installation is complete and all connections have been tightened, paint all bolt projections past the nuts with thread filling paint to prevent loosening and allow visual inspection of completed connections.

Figure 27A:
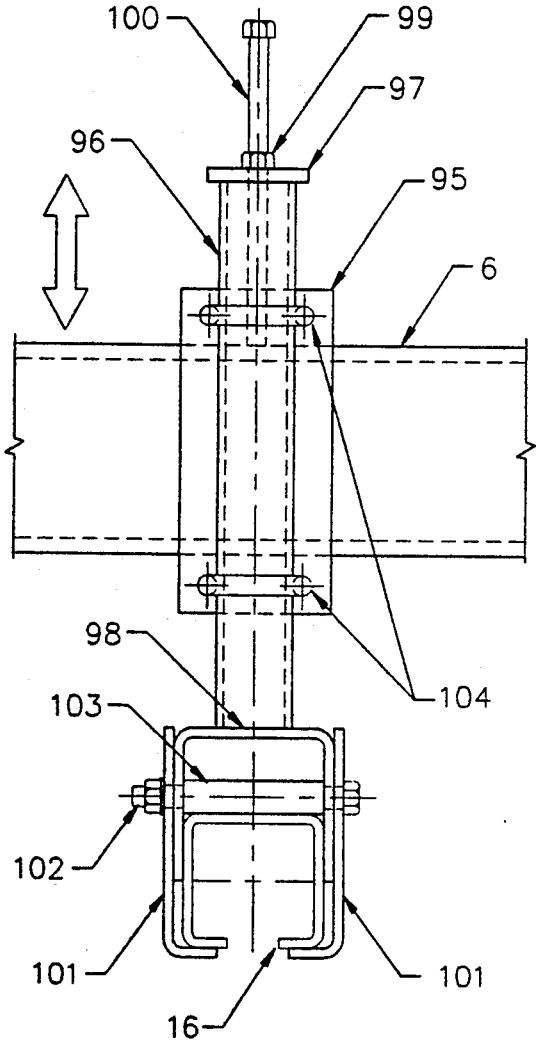
FIGS. 27*a* and 27*b* are orthogonal elevation views of the basic arrangement of the adjustable suspension bracket in inclining or declining positioning.
Figure 27B:
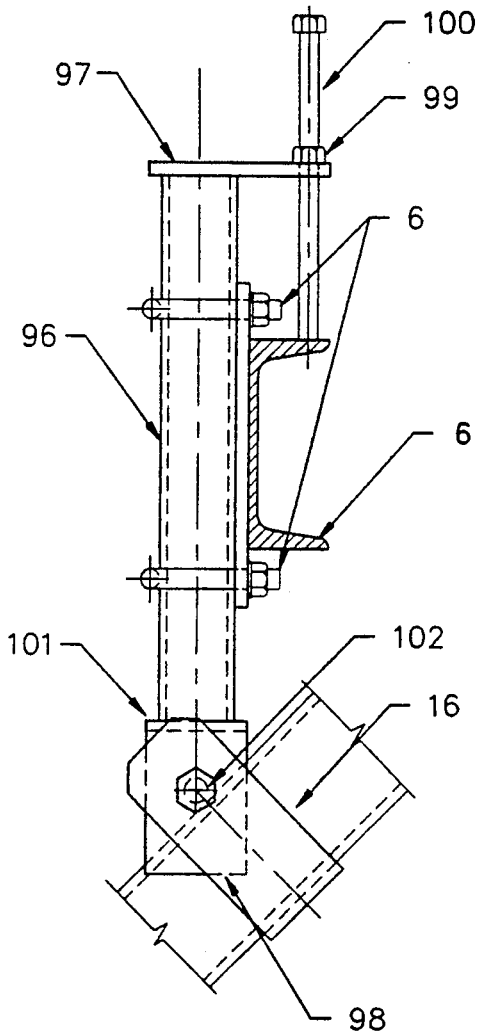

FIGS. 27*a* and 27*b* shows an adaptation of the adjustable suspension bracket 7 which allows its application in the suspension of an inclining or declining conveyor rail 16. All components of FIGS. 27*a* and 27*b* are the same as described in disclosure of FIGS. 26*a* and 26*b* except the upper horizontal legs of clamp fingers 101 have been eliminated in order to allow rotation of clamp fingers 101 about finger bolt 102. This adaptation is compatible with varying angles of inclination.

As with the adjustable suspension bracket shown in FIG. 26, the bracket arrangement shown in FIG. 27 can be adapted to support virtually any size or any shaped object as shown in FIG. 29.

Figure 30A:
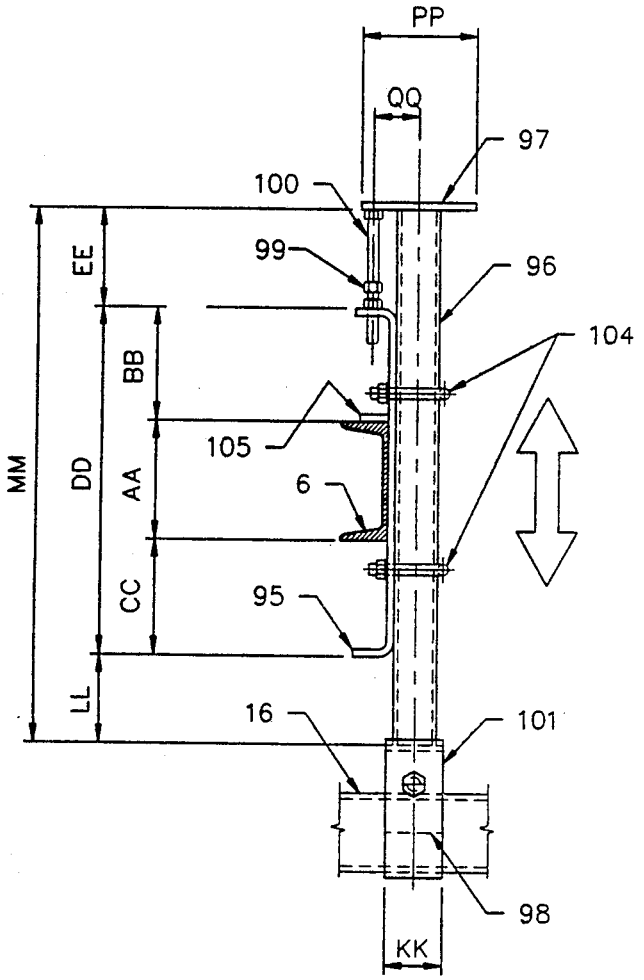
FIGS. 30*a* and 30*b* are orthogonal elevation views of another arrangement of the adjustable suspension bracket.
Figure 30B:
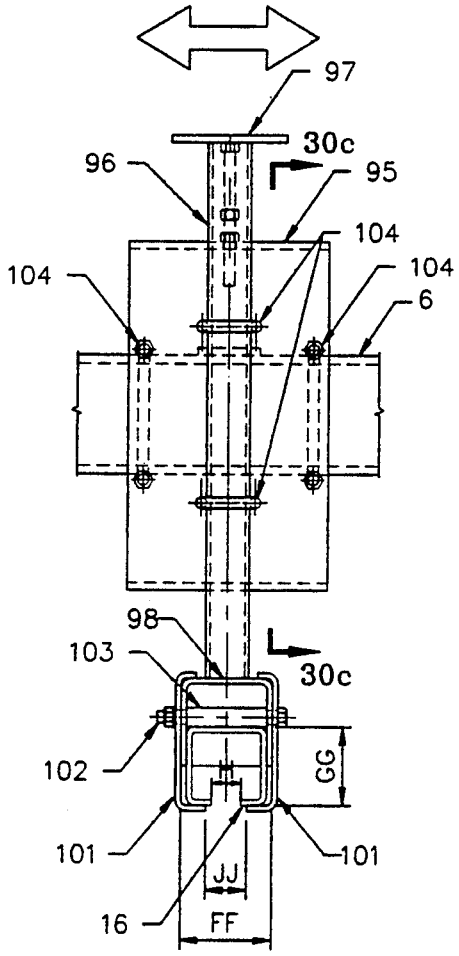
Figure 30C:
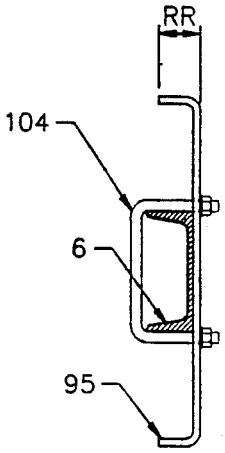
FIG. 30*c* is a sectional view of a detail from FIG. 30*b*.

FIGS. 30*a*–30*c* show a variation of the adjustable suspension bracket 7 which allows horizontal as well as vertical adjustment for precise location of a conveyor rail 16.

Mounting plate 95 and a bearing pad 105 can move horizontally along the upper horizontal surface of the horizontal suspension member 6. U-bolts 104, which surround horizontal suspension member 6 and pass through holes in the mounting plate 95, are tightened after precise location has been achieved forming a clamping condition.

The configuration of the adjustment bolt 100 is different than that of FIGS. 26 and 27 in that it does not pass through the cap 97 of round pipe 96. The lower of the two standard hex nuts 99 is welded to the mounting plate 95. Adjustment bolt 100 is then threaded into the lower hex nut 99 with the upper hex nut 99 moved to a mid way position on adjustment bolt 100. The cap 97 of the round pipe 96 bears directly on the head of adjustment bolt 100. By turning adjustment bolt 100, the round pipe 96 can be raised or lowered to achieve precise location of the conveyor rail 16 in the vertical plane. After precise location, the upper hex nut 99 is tightened against the lower hex nut 99, the upper most hex nut 99 acting as a lock nut to prevent loosening.

The dimension "AA" is the depth of the material chosen for the horizontal suspension member 6. Dimension "BB" should be such that when adjustment bolt 100 is in the maximum downward adjustment position, there will be clearance between it and the bearing pad 105 which is welded to the mounting plate 95. It is recommended that dimension "CC" equal dimension "BB" in order that the holes for U-bolts 104 can be located symmetrically on mounting plate 95.

The dimension "DD" is the sum of dimensions "AA", "BB" and "CC".

Dimension "EE" is the maximum downward adjustment. Dimension "LL" is the maximum upward adjustment. These dimensions are to be determined by the designer to meet the needs of the specific application of this invention.

Dimension "MM" is the total required length for the round pipe 96 and is the sum of dimensions "DD", "EE" and "LL".

The dimension "RR" is the horizontal leg of mounting plate 95 (FIG. 30*c*). It is recommended that this dimension be as small as possible to allow the hole for adjustment bolt 100 and the welding of the lower hex nut 99, and at the same time resisting deflection due to the adjustment of bolt 100.

The dimension "QQ" is based on the diameter of round pipe 96 and the dimensional requirements of dimension "RR".

The dimension "PP" of cap 97 should be such that there is complete coverage of the head of adjustment bolt 100. It is further recommended that cap 97 be a round shape so that the round pipe 96 can be rotated a full 360 degrees and full coverage of the adjustment bolt 100 will be achieved in any position.

The conveyor rail 16, bent saddle plate 98, U-bolts 104, round pipe spacer 103, clamp fingers 101 and finger bolt 102 function as previously described with respect to FIG. 26.

It is the object of this invention that the adjustable suspension bracket 7 can be used in a situation where horizontal and vertical adjustment capabilities are required, as well as the ability to rotate about the center of the round pipe 96.

It is further an object of this invention that, through its ability to be connected to an existing structural member 17 without the need of drilling connection holes or welding, it can be used to suspend a conveyor rail 16 or similar object from the existing support member 17.

Figure 31A:
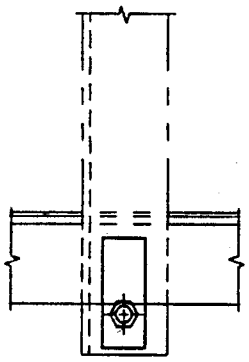
FIGS. 31*a* and 31*b* are orthogonal elevation views which illustrate the flexibility of the safety net connector in various conditions.
Figure 31B:
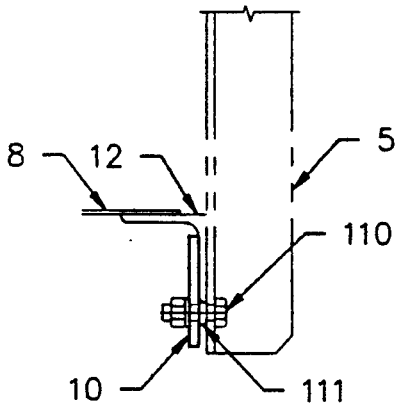
Figure 32A:
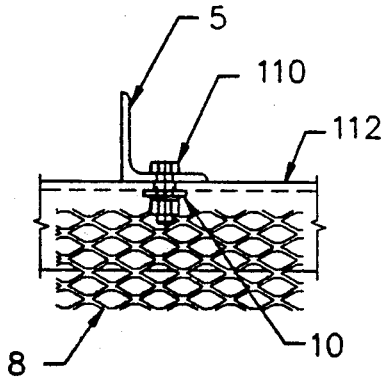
FIGS. 32*a*–32*e* illustrate some of the practical uses of the safety net connector.
Figure 32B:
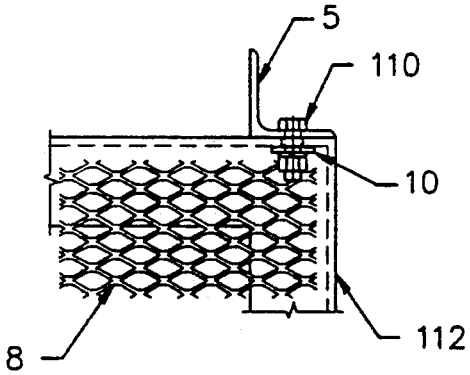
Figure 32C:
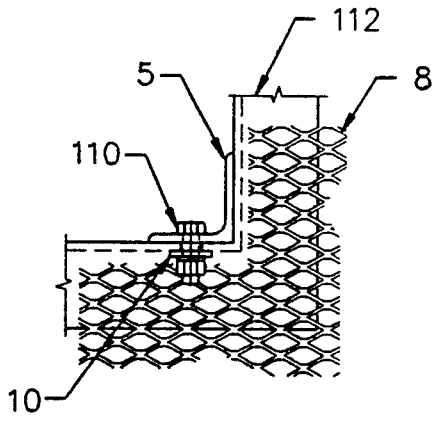
Figure 32D:
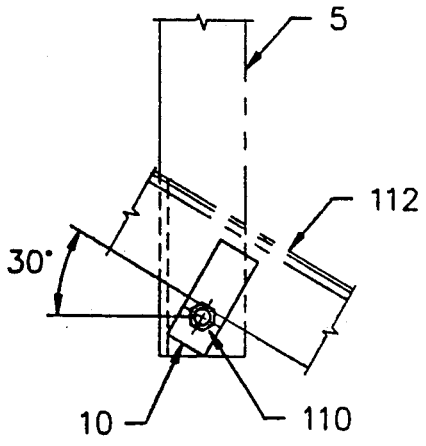
Figure 32E:
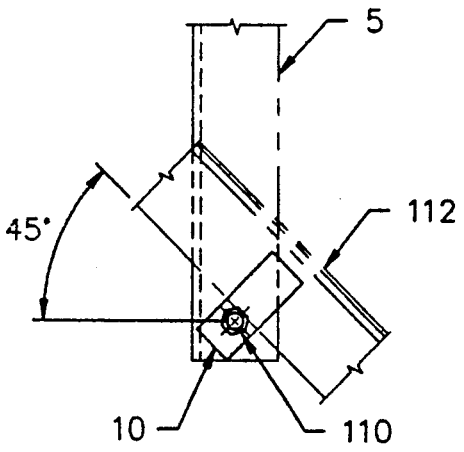

FIG. 31 shows the connection of the horizontal safety net 8 to the vertical suspension member 5 by means of the safety net connector 10.

The safety net connector 10 is attached to the vertical suspension member 5 by means of safety bolt 110 which passes through a hole in the vertical suspension member 5, a round pipe spacer 111 and a hole in the net connector 10 forming a clamping type bolted connection.

The length of round pipe spacer 111 should be slightly less than the thickness of a safety net member 112 to assure a secure clamping connection. The wall thickness of round pipe spacer 111 should be thick enough to prevent collapse of the spacer under tightening and to avoid the spacer being pulled through holes under tightening.

The thickness of safety net connector 10 should be greater than or equal to the thickness of material used for vertical suspension member 5.

FIGS. 32*a*-32*e* show various conditions in which the net connector may be used.

After the safety net 8 is in it's final position and net connector 10 has been rotated about safety bolt 110 until it is perpendicular to the surface of the safety net 8, safety bolt 110 is tightened until a lock washer is fully compressed, then bolt projection past the nut is to be painted with thread filling paint to prevent loosening.

What is claimed is:

1. An overhead conveyor suspension system for suspending a rail from existing structural members, said suspension system comprising:

a plurality of sub-beams suspended from said existing structural members, said sub-beams being suspended substantially horizontally by a plurality of girder brackets;

a plurality of track beams extending between at least two of sid plurality of sub-beams, said track beams are oriented perpendicular to said rail and are mounted on said sub-beams by track beams connectors;

a plurality of vertical suspension members suspended from said track beams by track beam brackets;

a plurality of horizontal suspension members extending between and connected to at least two of said plurality of vertical suspension members; and an adjustable suspension bracket suspending said rail from said horizontal suspension member, wherein said adjustable suspension brackets include first adjustment means for adjustably suspending said rail from said horizontal suspension members, said first adjustment means comprising an adjustment bolt adapted to vary the distance said horizontal suspension members and said rail.

2. The overhead conveyor suspension system according to claim 1, wherein said plurality of girder brackets clamp said plurality of sub-beams to said existing structural members without penetrating said existing structural members.

3. The overhead conveyor suspension system according to claim 2, wherein said girder brackets are adapted to enable angular adjustment of the sub-beam with respect to said existing structural member.

4. The overhead conveyor suspension system according to claim 1, wherein said track beam connectors clamp said track beams to said sub-beams without penetrating either of said sub-beams and track beams.

5. The overhead conveyor suspension system according to claim wherein said track beam brackets clamp said vertical suspension members to said track beams without penetrating said track beams.

6. The overhead conveyor suspension system according to claim 1, wherein said adjustable suspension brackets clamp said horizontal suspension members to said rail without penetrating said rail.

7. The overhead conveyor suspension system according to claim 1, wherein said adjustable suspension brackets clamp said horizontal suspension members to said rail without penetrating said horizontal suspension members and rail.

8. The overhead conveyor suspension system according to claim 1, wherein said adjustable suspension brackets include second adjustment means for adjustably suspending said rail from said horizontal suspension members, said second adjustment means adapted to enable angular variation between said horizontal suspension member and said rail.

9. The overhead conveyor suspension system according to claim 1, further comprising a safety net suspended below said rail on extensions of said plurality of vertical suspension members, said safety net connected to said plurality of vertical suspension members by safety net connectors.

10. The overhead conveyor suspension system according to claim 9, wherein said safety net connectors clamp said safety net to said plurality of vertical suspension members.

11. The overhead conveyor suspension system according to claim 1, wherein said plurality of horizontal suspension members are connected to a pair of said plurality of vertical suspension members.

12. The overhead conveyor suspension system according to claim 1, wherein a plurality of said adjustable suspension brackets are suspended from one of said horizontal suspension members.

13. The overhead conveyor suspension system according to claim 1, further comprising anti-sway bracing, said anti-sway bracing including diagonal type anti-sway bracing extending obliquely between different ones of said vertical suspension members, and V-type anti-sway bracing extending obliquely between at least one of said plurality of track beams and each of two said vertical suspension members associated therewith.

14. The overhead conveyor suspension system according to claim 13, wherein both said diagonal type anti-sway bracing and said V-type anti-sway bracing are connected to said vertical suspension members by sliding bracing connectors.

15. The overhead conveyor suspension system according to claim 14, wherein both said diagonal type anti-sway bracing and said V-type anti-sway bracing are connected to said vertical suspension member by the same said sliding bracing connector.

16. The overhead conveyor suspension system according to claim 1, wherein a second plurality of vertical suspension members are suspended from said plurality of sub-beams by sub-beam brackets.

17. The overhead conveyor suspension system according to claim 16, wherein said sub-beam brackets clamp said second plurality of vertical suspension members to said plurality of subbeams without penetrating said plurality of sub-beams.

18. An overhead conveyor suspension system for suspending a rail from existing structural members, said suspension system comprising:

a plurality of sub-beams suspended from said existing structural members, said sub-beams being suspended substantially horizontally by a plurality of girder brackets;

a plurality of track beams extending between at least two of sid plurality of sub-beams, said track beams are oriented perpendicular to said rail and are mounted on said sub-beams by track beams connectors;

a plurality of vertical suspension members suspended from said track beams by track beam brackets;

a plurality of horizontal suspension members extending between and connected to at least two of said plurality of vertical suspension members; and an adjustable suspension bracket suspending said rail from said horizontal suspension member;

wherein said plurality of girder brackets clamp said plurality of sub-beams to said existing structural members without penetrating said existing structural members and are adapted to enable angular adjustment of the sub-beam with respect to the existing structural members; and wherein each of said plurality of girder brackets comprise an upper unit, upper clamp angles and bolt means for clamping said upper unit and said upper clamp angle to said existing structural members, whereby said bolt means pass through said upper unit and said upper clamp angles to form a clamp type connection.

19. The overhead conveyor suspension system according to claim 18, wherein said upper unit comprises pivot means for adapting said girder bracket to a slope of said existing structural members.

20. The overhead conveyor suspension system according to claim 18, further comprising a lower unit secured to said upper unit through said pivot means.

21. An overhead conveyor suspension system for suspending a rail from existing structural members, said suspension system comprising:

a plurality of sub-beams suspended from said existing structural members, said sub-beams being suspended substantially horizontally by a plurality of girder brackets;

a plurality of track beams extending between at least two of sid plurality of sub-beams, said track beams are oriented perpendicular to said rail and are mounted on said sub-beams by track beams connectors;

a plurality of vertical suspension members suspended from said track beams by track beam brackets;

a plurality of horizontal suspension members extending between and connected to at least two of said plurality of vertical suspension members;

an adjustable suspension bracket suspending said rail from said horizontal suspension member; and anti-sway bracing, wherein said anti-sway bracing comprises diagonal type anti-sway bracing extending obliquely between different ones of said vertical suspension members, and V-type anti-sway bracing extending obliquely between at least one of said plurality of track beams and said vertical suspension members associated therewith.

* * * * *